US008662302B2

(12) United States Patent
Lau

(10) Patent No.: US 8,662,302 B2
(45) Date of Patent: Mar. 4, 2014

(54) PACKAGING FOR ENERGY FOODS OR OTHER SUBSTANCES

(76) Inventor: Jan R. Lau, Windsor, CA (US)

( * ) Notice: Subject to any disclaimer, the term of this patent is extended or adjusted under 35 U.S.C. 154(b) by 0 days.

(21) Appl. No.: 13/598,472

(22) Filed: Aug. 29, 2012

(65) Prior Publication Data

US 2013/0248405 A1 Sep. 26, 2013

Related U.S. Application Data

(60) Provisional application No. 61/613,840, filed on Mar. 21, 2012.

(51) Int. Cl.
*B65D 73/00* (2006.01)

(52) U.S. Cl.
USPC ..... 206/467; 206/815

(58) Field of Classification Search
USPC ..... 206/484, 484.1, 484.2, 461, 466, 467, 206/469, 470, 471, 815
See application file for complete search history.

(56) References Cited

U.S. PATENT DOCUMENTS

| | | | | | |
|---|---|---|---|---|---|
| 1,536,341 | A * | 5/1925 | Hodgson | 378/169 |
| 1,699,278 | A * | 1/1929 | Bruun | 206/496 |
| 2,349,985 | A * | 5/1944 | Page | 220/315 |
| 3,109,576 | A * | 11/1963 | Karl | 229/201 |
| 3,567,108 | A | 3/1971 | Corridon | |
| 3,891,775 | A * | 6/1975 | Murray et al. | 426/107 |
| 3,968,926 | A * | 7/1976 | Smolderen et al. | 229/87.05 |
| 4,091,930 | A * | 5/1978 | Buchner et al. | 229/200 |
| 4,153,091 | A * | 5/1979 | Jahn | 206/523 |
| 4,821,950 | A * | 4/1989 | Sanchez et al. | 229/160.2 |
| 4,826,059 | A * | 5/1989 | Bosch et al. | 224/183 |
| 5,511,680 | A * | 4/1996 | Kinne | 206/276 |
| 5,524,759 | A | 6/1996 | Herzberg et al. | |
| 5,609,246 | A * | 3/1997 | Borghorst et al. | 206/5.1 |
| 5,979,653 | A * | 11/1999 | Owens et al. | 206/484.1 |
| 6,085,942 | A * | 7/2000 | Redmond | 222/107 |
| 6,280,085 | B1 * | 8/2001 | Beer | 383/210 |
| 6,287,002 | B1 * | 9/2001 | Sherman et al. | 383/74 |
| 6,290,084 | B1 | 9/2001 | Louie | |
| 6,499,595 | B1 * | 12/2002 | Petricca | 206/356 |
| 6,698,928 | B2 | 3/2004 | Miller | |
| 6,918,532 | B2 | 7/2005 | Sierra-Gomez et al. | |
| 7,216,764 | B2 | 5/2007 | Forman | |
| 7,350,688 | B2 | 4/2008 | Sierra-Gomez et al. | |
| 7,866,473 | B2 | 1/2011 | Clark, Jr. et al. | |
| 2003/0089713 | A1 | 5/2003 | Belt et al. | |
| 2003/0168365 | A1 * | 9/2003 | Kaern | 206/364 |
| 2004/0084452 | A1 | 5/2004 | Hsieh | |

(Continued)

FOREIGN PATENT DOCUMENTS

| | | |
|---|---|---|
| JP | 2001-130635 | 5/2001 |
| KR | 10-2004-0040987 | 5/2004 |

*Primary Examiner* — Jacob K Ackun
(74) *Attorney, Agent, or Firm* — Knobbe, Martens, Olson & Bear, LLP

(57) ABSTRACT

A consumer package is disclosed that can be opened with one hand. The packaging can have a finger or thumb loop attached to a panel that allows a user to use a finger of the same hand holding the package to open the package. The finger or thumb loop can be designed to have strength and structural integrity to open the package rather than just to hold the package. The package can have a finger or thumb grip portion attached to the panel to open the package. The package can have a finger or thumb hold attached to the panel to open the package.

8 Claims, 16 Drawing Sheets

(56) References Cited

U.S. PATENT DOCUMENTS

2006/0249424 A1* 11/2006 Mormina et al. ..... 206/562
2007/0051645 A1* 3/2007 Hassett ..... 206/316.2
2007/0102317 A1* 5/2007 Crawford et al. ..... 206/470
2008/0063324 A1 3/2008 Bernard et al.
2012/0255882 A1* 10/2012 Glass ..... 206/232
2012/0305445 A1* 12/2012 Hu ..... 206/775

* cited by examiner

PACKAGING FOR ENERGY FOODS OR OTHER SUBSTANCES

CROSS-REFERENCE TO RELATED APPLICATIONS

This application claims the benefit of U.S. Provisional Application No. 61/613,840, filed Mar. 21, 2012, the entirety of which is incorporated by reference herein.

BACKGROUND

1. Field of the Inventions

The inventions generally relate to packaging. More particularly, the inventions generally relate to quick dispensing consumer packaging.

2. Description of the Related Art

Consumer packaging utilizes many different designs as well as materials to deliver goods to a consumer. Some packaging is meant for bulk items or for packaging of many items together. Other packaging delivers just a single good to the consumer. For instance, candy bars are individually wrapped with the intention that the consumer open the packaging and consume that single candy bar. When consumer packaging is designed, the ultimate end-use of the consumer is important.

SUMMARY

Consumer packaging is becoming ever increasingly popular, particularly flexible packaging. Conventional designs use materials that allow for sealable laminates that result in packaging having improved sealing and barrier characteristics. However, these materials often increase the tear-open resistance. In some cases, packaging can be tough to open and can require tools such as a knife or scissors.

There are various designs on the market for maintaining packaging integrity while decreasing tear open resistance. For instance, slits or v-notches can be provided on the edges of packages to provide a tear open initiation site. Tear strips or tear strings have also been employed to improve the ease of opening a package. However, the tear strips or tear strings can be difficult to grip. Even if not difficult to grip, these designs often require the use of two hands to open. For example, one hand of the user pulls on the tear string while the other hand holds the package. Further, tear strips and tear strings can be difficult and expensive to manufacture. Even without the difficulty and expense, tear strips or tear strings create only a linear opening, which does not facilitate easy access to the contents contained within the package.

In some consumer applications, the balance between integrity of the packaging and ease of opening the packaging can limit the packaging's utility. For instance, endurance athletes such as cyclists and tri-athletes eat during races. It is often difficult to bring two hands together during rigorous activity to open a package containing foods such as an energy bar, energy blocks, energy waffles, energy gels, candy, and/or other similar food contents. For example, a cyclist typically wants to maintain at least one hand on the handlebar to control the bicycle. This challenge is further exacerbated if the athlete's hands happen to be wet or oily, or become weakened with advanced age. Nevertheless, an athlete cannot utilize packaging that breaks or tears open before the athlete is ready to consume the food. Not only will the packaged food content likely get soiled, the food will likely also get scattered and become unusable.

In some consumer applications, the above objectives can also be applied in other contexts such as, for example, to be used by persons who have limited use of one hand or lack strength in the hand. Persons with limited hand use may have a need for a food packaging that maintains its integrity, but can also be easily opened.

To balance the needs of providing packaging that can be easily opened, particularly with one hand, while maintaining package integrity, one or more embodiments disclosed herein allow the user to open a package with one hand and, in some cases, without having to look at the package. The packaging can have a finger or thumb loop attached to a panel that allows the user to use a finger of the same hand holding the package to open the package. The finger or thumb loop can be designed to have strength and structural integrity to open the package rather than just to hold the package.

In some embodiments, an easy-open energy food package comprises a package body comprising a first panel and a second panel defining a space therebetween to receive an energy food. The package body can have an upper end, a lower end, a first side extending between the upper end and the lower end and a second side extending between the upper end and the lower end. The package body can be sized and shaped to be held in a single hand of a user. At least one finger or thumb loop can be secured to one of the first panel or the second panel. The at least one finger or thumb loop can have a first end, a second end and an intermediate portion between the first end and the second end. The first end can be secured to the one of the first panel or the second panel at a first region and the second end can be secured to the one of the first panel or the second panel at a second region, which is separate from and spaced from the first region. The at least one finger or thumb loop comprises a first finger or thumb loop secured to the first panel and a second finger or thumb loop secured to the second panel. The second region can be spaced from the first region in parallel relative to the first side of the package body. The second region can be spaced from the first region such that upon securing the first end and the second end, the intermediate portion is longer than the space between the first region and the second region. The first end can extend substantially a width of the first panel.

In some embodiments, an easy-open energy food package comprises a package body sized and shaped to be held in a single hand of a user. The package body comprises a first panel and a second panel defining a space therebetween to receive an energy food. The package body can have a first end, a second end opposite the first end, a first side extending between the first end and the second end and a second side opposite the first side extending between the first end and the second end. A corner can be defined by an intersection of each side and each end. A finger or thumb loop can be secured to the first panel at one of the corners. The finger or thumb loop comprises a portion and a loop. The portion can be secured to the first panel at the one of the corners. The portion can space the loop from the one of the corners. The finger or thumb loop comprises a loop having a central axis. The finger or thumb loop can be secured to the first panel at the one of the corners such that the central axis is parallel relative to one of the first end or the first side. The finger or thumb loop comprises a loop having a central axis. The finger or thumb loop can be secured to the first panel at the one of the corners such that the central axis is angled relative to the first end. The first panel and the finger or thumb loop can be formed from a same piece of material such that the finger or thumb loop is unitary with the first panel and extends from the first panel. Another finger or thumb loop can be secured to the first panel at a different one of the corners.

In some embodiments, an easy-open energy food package comprises a tray having a surface defining an interior portion and a peripheral edge circumscribing the interior portion, a cover layer having a surface that is adhered to the peripheral edge of the tray and covers an entirety of the interior portion of the tray. The tray and the cover layer can cooperate to define a package body that, in use, encloses an energy food. At least one finger or thumb loop can be secured to the cover layer so that, in use, the at least one finger or thumb loop can be utilized to assist in removal of the cover layer from the tray. The interior portion can be recessed from the peripheral edge to define an interior space for the energy food. The tray comprises a protrusion initially extending in a first direction away from the interior space. The protrusion, in use, can be depressed such that it extends in a second direction into the interior space to separate the energy food from at least a portion of the surface of the tray that is adjacent the protrusion. The cover layer and the at least one finger or thumb loop can be formed from a same piece of material such that the at least one finger or thumb loop is unitary with the cover layer and extends from the cover layer. The tray comprises corners at the peripheral edge. The at least one finger or thumb loop can be secured to one of the corners. The at least one finger or thumb loop comprises a portion and a loop such that the portion is secured to the cover layer at the peripheral edge. The portion can space the loop from the peripheral edge. The food package can further comprise at least another finger or thumb loop secured to the cover layer. The at least one finger or thumb loop can secured to the cover layer at a first location, and the at least another finger or thumb loop can secured to the cover layer at a second location, which is separate from and spaced from the first location. The tray can also include a protrusion initially extending in a first direction away from an interior space of the package. The protrusion, in use, can be depressed such that it extends in a second direction into the interior space to separate the energy food from at least a portion of the surface of the tray that is adjacent the protrusion.

In some embodiments, an easy-open energy food package comprises a package body sized and shaped to be held in a single hand of a user. The package body comprises a front panel and a rear panel defining a space therebetween to receive an energy food. The package body can have a first end, a second end opposite the first end, a first side extending between the upper end and the lower end and a second side opposite the first side extending between the first end and the second end. At least one finger or thumb loop can be secured to the front panel or the rear panel. The at least one finger or thumb loop can be constructed from a first material. The package body can be constructed from a second material that is different than the first material. The first material can have resilient properties sufficient to create a force tending to open the at least one finger or thumb loop. The at least one finger or thumb loop comprises a portion and a loop. The portion can be secured at a region of one of the front panel and the rear panel, the portion spacing the loop from the region. The region can be a peripheral edge of the front panel. The at least one finger or thumb loop is constructed from a single thermoplastic material. The at least one finger or thumb loop can be further constructed from a second material such that the first material forms a first layer of the at least one finger or thumb loop and the second material forms a second layer of the at least one finger or thumb loop. The first layer and the second layer can circumscribe entirely the at least one finger or thumb loop. The first layer can form an inside layer of the at least one finger or thumb loop, and the second layer can form an outside layer of the at least one finger or thumb loop. The first material comprises a thermoplastic material, such as low-density polyethylene (LDPE). The second material comprises a flexible film material, such as polyethylene terephthalate (PET).

In some embodiments, an easy-open energy food package comprises a package body comprising a first panel and a second panel defining a space therebetween to receive an energy food. The package body can have an upper end, a lower end, a first side extending between the upper end and the lower end and a second side extending between the upper end and the lower end. The package body can be sized and shaped to be held in a single hand of a user. A first finger or thumb loop can be secured to the first panel at a first location. A second finger or thumb loop can be secured to the first panel at a second location spaced from the first location. The first location can be positioned at the upper end, and the second location can be positioned at the lower end. The first location can be positioned at the first side and the second location can be positioned at the second side. A corner can be defined by an intersection of each side and each end. The first finger or thumb loop can be positioned at a first one of the corners, and the second finger or thumb loop can be positioned at a second one of the corners.

In some embodiments, an easy-open energy food package comprises a package body comprising a first panel and a second panel defining a space therebetween to receive an energy food. The package body can have an upper end, a lower end, a first side extending between the upper end and the lower end and a second side extending between the upper end and the lower end. The package body can be sized and shaped to be held in a single hand of a user. At least a first seam can extend along one of the upper end, the lower end, the first side and the second side. A second seam can extend along a different one of the upper end, the lower end, the first side and the second side. Each of the first seam and the second seam comprises a region in which the first panel and the second panel can be secured to one another. A strength of the first seam can be different from a strength of the second seam. The first seam can extend along the upper end, and the second seam can extend along the lower end. The first seam strength can be less than the second seam strength. The package can further comprise a third seam extending along the first side and a fourth seam extending along the second side. Each of the third seam and fourth seam comprise a region in which the first panel and the second panel can be secured to one another, and the third seam and the fourth seam can each have substantially a same strength. The strength of the third seam and the fourth seam can be greater than the first seam strength and less than the second seam strength. The package can further comprise at least one finger or thumb loop secured to the first panel using another seam that can having a strength greater than the first seam strength. The other seam strength can be equal to the second seam strength. The package can further comprise a tear line on the first panel extending in parallel relative to the first side and the second side. The tear line can weaken the first panel to provide a preferential opening path.

In some embodiments, an easy-open energy food package comprises a tray having a surface defining an interior portion and a peripheral edge circumscribing the interior portion and a cover layer having a surface that is adhered to the peripheral edge of the tray and covers an entirety of the interior portion of the tray. The tray and the cover layer can cooperate to define a package body that, in use, encloses an energy food. At least one finger or thumb grip portion can be secured to the cover layer and can have an enhanced friction surface portion, which has a coefficient of friction greater than the cover layer so that, in use, the at least one finger or thumb grip portion can be utilized to assist in removal of the cover layer from the tray.

The at least one finger or thumb grip portion can protrude from the peripheral edge of the cover layer. The interior portion can be recessed from the peripheral edge to define an interior space for the energy food. The tray comprises a protrusion initially extending in a first direction away from the interior space. The protrusion, in use, can be depressed such that it extends in a second direction into the interior space to separate the energy food from at least a portion of the surface of the tray that is adjacent the protrusion. The cover layer and the at least one finger or thumb portion can be formed from a same piece of material such that the at least one finger or thumb grip portion is unitary with the cover layer and extends from the cover layer. The tray comprises corners at the peripheral edge. The at least one finger or thumb loop can be secured to one of the corners. At least another finger or thumb grip portion can be secured to the cover layer. The at least one finger or thumb loop can secured to the cover layer at a first location, and the at least another finger or thumb loop can be secured to the cover layer at a second location, which is separate from and spaced from the first location. The at least one finger or thumb grip portion can have a smooth surface portion positioned such that the smooth surface portion can slide on the cover layer when pressed against the cover layer by application of force to the enhanced friction surface portion.

In some embodiments, an easy-open energy food package comprises a tray having a surface defining an interior portion and a peripheral edge circumscribing the interior portion and a cover layer having a surface that is adhered to the peripheral edge of the tray and covers an entirety of the interior portion of the tray. The tray and the cover layer can cooperate to define a package body that, in use, encloses an energy food within an interior space. The tray comprises a protrusion initially extending in a first direction away from the interior space. The protrusion, in use, can be depressed such that it extends in a second direction into the interior space to separate the energy food from at least a portion of the surface of the tray that is adjacent the protrusion. The protrusion can be offset from a center of a length of the tray. The tray and the protrusion can be formed from a same piece of material such that the protrusion is unitary with the tray. A depth of the protrusion can be about half of a depth of the interior space.

In some embodiments, an easy-open energy food package comprises a tray having a surface defining an interior portion and a peripheral edge circumscribing the interior portion and a cover layer having a surface that is adhered to the peripheral edge of the tray and covers an entirety of the interior portion of the tray. The tray and the cover layer can cooperate to define a package body that, in use, encloses an energy food. At least one finger or thumb hold can be secured to the cover layer and having a finger or thumb grip surface so that, in use, the at least one finger or thumb hold can be utilized to assist in removal of the cover layer from the tray. The tray comprises corners at the peripheral edge. The at least one finger or thumb hold can be secured at one of the corners. The finger or thumb hold can comprise a knob protruding from the package that can be utilized to assist in removal of the cover layer from the tray. At least one internal finger or thumb hold can be secured to an inside face of the cover layer and having a finger or thumb grip surface so that, in use, the at least one internal finger or thumb hold can be utilized to assist in removal of the cover layer from the tray when the inside face of the cover layer has been exposed. The internal finger or thumb hold can comprise a pin. The internal finger or thumb hold can be located at a same location of the inside face of the cover layer as the finger or thumb hold on an outside face of the cover layer. The pin can be inserted into the finger or thumb hold to secure together the internal finger or thumb hold and the finger or thumb hold. The interior portion can be recessed from the peripheral edge to define an interior space for the energy food. The tray can comprise a protrusion initially extending in a first direction away from the interior space. The protrusion, in use, can be depressed such that it extends in a second direction into the interior space to separate the energy food from at least a portion of the surface of the tray that is adjacent the protrusion.

The foregoing is a summary and thus contains, by necessity, simplifications, generalization, and omissions of detail; consequently, those skilled in the art will appreciate that the summary is illustrative only and is not intended to be in any way limiting. Other aspects, features, and advantages of the devices and/or processes and/or other subject matter discussed herein will become apparent in the teachings set forth herein. The summary is provided to introduce a selection of concepts in a simplified form that are further described below in the Detailed Description. This summary is not intended to identify key features or essential features of any subject matter discussed herein.

BRIEF DESCRIPTION OF THE DRAWINGS

The foregoing and other features of the present disclosure will become more fully apparent from the following description, taken in conjunction with the accompanying drawings. Understanding that these drawings depict only some embodiments in accordance with the disclosure and are, therefore, not to be considered limiting of its scope, the disclosure will be described with additional specificity and detail through use of the accompanying drawings.

DETAILED DESCRIPTION

Figure 1:
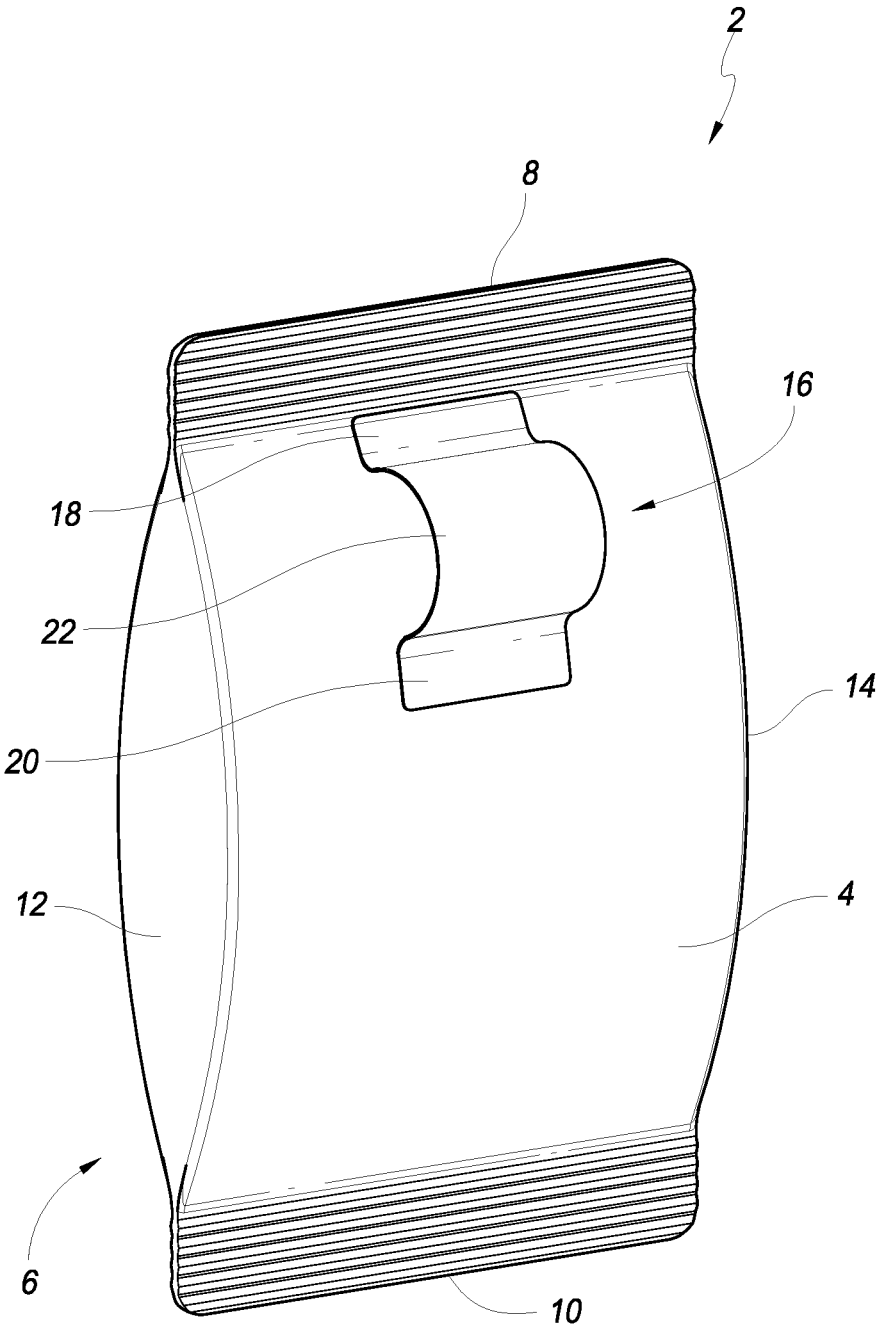
FIG. 1 shows a perspective view of an embodiment of an easy-open package.

In the following detailed description, reference is made to the accompanying drawings, which form a part hereof. In the drawings, similar symbols typically identify similar components, unless context dictates otherwise. The illustrative embodiments described in the detailed description and drawings are not meant to be limiting. Other embodiments may be utilized, and other changes may be made, without departing from the spirit or scope of the subject matter presented here. It will be readily understood that the aspects of the present disclosure, as generally discussed herein, and illustrated in the Figures, may be arranged, substituted, combined, and designed in a wide variety of different configurations, all of which are explicitly contemplated and made part of this disclosure.

In particular, the disclosed embodiments relate to packaging. FIG. 1 shows a perspective view of an embodiment of an easy-open package 2. In the illustrated arrangement, the package 2 is well-suited for use as food packaging and, in particular, as energy food packaging. Energy food is used by endurance athletes for in-training or in-competition fuel. Accordingly, ease of access to the contents of the package 2 is beneficial to the user. Moreover, in some arrangements, the packages 2 allow access to the contents using only one hand. Thus, the disclosure contained herein is in the context of food (e.g., energy food) packaging. However, the packages 2 described herein may be useful in other applications and/or modified for use in other applications, such as packaging directed towards users that have limited use or strength of one hand. Therefore, the contents of the package can be any desired item(s), including food/edible items or non-food/non-edible items. Thus, the use of "food contents" within the detailed description is used merely for convenience and is intended to cover any food or non-food contents, which could be utilized with the disclosed packaging or a modification thereof. In some embodiments, the package 2 can have an ocular shaped side profile. In some embodiments, the package side profile shape can range from being rectangular to relatively flat. The package body 2 can be generally sized and shaped to be held in a single hand of the user. The package 2 can have a first (front) wall or panel 4, a second (rear) wall or panel 6, an upper end 8, and a lower end 10. A first side 12 can extend between the upper end 8 and lower end 10. A second side 14 can extend between the upper and 8 and the lower and 10 opposite the first side 12. In some embodiments, the package 2 may not have a distinguishable upper end, lower end or sides. For example, the package 2 could have a circular shape (e.g., from a front or rear view). Such a package could be viewed as having an upper end, lower end and sides, although such features may be structurally unique or distinguishable from one another. Accordingly, the package 2 does not necessarily have the illustrated shapes (e.g., generally rectangular), or any other shape having linear edges. Thus, the package 2 can have any desired shape. However, for some applications, a generally rectangular shape is desirable because it allows a user to orient the package 2 quickly and easily, often without visual contact.

In some embodiments, the upper end 8 and the lower end 10 can be sealed to form seams using permanent adhesive, reusable adhesive, or combination of permanent and reusable adhesive, thermal bonds, ultrasonic bonds, spot welds, i.e., thermal weld points, a stitch or stitches, strip welds, tacks formed by crimping, perforations, and so forth, including any combination thereof. The first side 12 and the second side 14 can be creases formed in the packaging material and/or can also use any combination of the aforementioned sealing mechanisms.

In some embodiments, the package body 2 can be formed from a single piece of material. When the package body 2 is formed from a single piece of material wrapping food contents, the package body 2 can have two seams at the upper end 8 and the lower end 10, and a single, vertical seam on one of the first panel 4 or the second panel 6. In some embodiments, the package body 2 can be formed from two pieces of material fitted together to enclose food contents. When the package body 2 is formed from two pieces of material, the package body can have two seams at the upper end 8 and the lower end 10, and two seams at the first side 12 and the second side 14. In some embodiments, the material forming the package 2 can have a thickness of about 2 mils, which can help retain package integrity while keeping material costs down. In some embodiments, the material forming the package 2 can have a thickness of about 4 mils, which can help in applications requiring increased package integrity. In some embodiments, the material forming the package 2 can have a thickness of about 0.5, 0.75, 1, 1.25, 1.5, 1.75, 2.25, 2.5, 2.75, 3, 3.25, 3.5, 3.75, 4, 4.25, 4.5, 4.75, 5, 5.25, 5.5, 4.75, 6, 6.25, 6.5, 6.75, and 7 mils, including ranges bordering and including the foregoing values.

In some embodiments, the easy-open package 2 can have a finger or thumb loop 16 attached to one of the first panel 4 or the second panel 6. In some embodiments, the material forming the first panel 4 and the second 6 can have a thickness of about 2 mils, while the material forming the finger or thumb loop 16 can have a thickness of about 4 mils, which can help keep overall material costs down while adding structural integrity to the finger or thumb loop 16. In some embodiments, the package 2 can have two or more finger or thumb loops 16 attached to the first panel 4 and/or the second panel 6. While the finger or thumb loop 16 is shown to be closer to the upper end 8, as will become apparent from the description herein, the exact location and orientation of the finger or thumb loop 16 can be anywhere on the package body 2 as long as it is located appropriately for the user to open the package 2 and access the food contents in the manner to be discussed herein.

In some embodiments, the finger or thumb loop 16 can have a first end 18, a second end 20, and an intermediate portion 22. The first end 18 can be attached anywhere (a first region) on the one of the first panel 4 or the second panel 6. The first end 18 can be attached at or near the upper end 8. The second end 20 can be attached at a second region spaced apart from the first region such that the distance between the first end 18 and the second end 20 is shorter than a length of the intermediate portion 22, thereby creating a space or loop between the intermediate portion 22 and the first panel 4. Such an arrangement and attachment of the first end 18, the second end 20, and the intermediate portion 22 can give strength and structural integrity to open the package 2 as discussed herein rather than just to hold the package 2.

The first end 18 can be spaced apart from the second end 20 in parallel relative to one another. The first end 18 can be spaced apart from the second end 20 in a direction along the first end 12. The first end 18 can be spaced apart from the second end 20 in a direction along the upper end 8. The intermediate portion 22 can protrude from the first panel 4 to form a loop for the insertion of a finger or thumb. The finger or thumb loop 16 can be attached to the first panels 4 using any combination of the sealing methods as discussed herein.

The finger or thumb loop 16 can be any suitable size, shape, and geometry to accommodate any one finger of a human hand. The finger or thumb loop 16 can also be any suitable size, shape, and geometry to provide sufficient room for a person to be able to hook a prosthetic hook, pen, spoon, fork, knife, or other objects suitable in assisting to open package 2. In some embodiments, the finger or thumb loop 16 can be large enough for a person to insert two, three, or four fingers.

Figure 11A:
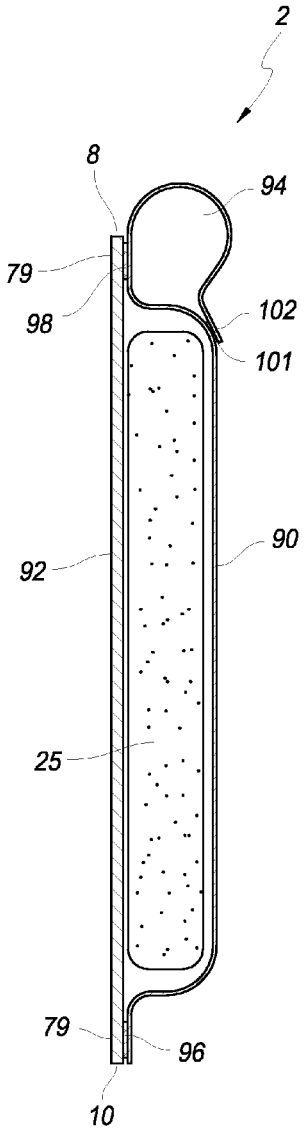
FIGS. 11A-B show a cross-sectional view of another embodiment of an easy-open package having a tray.
Figure 11B:
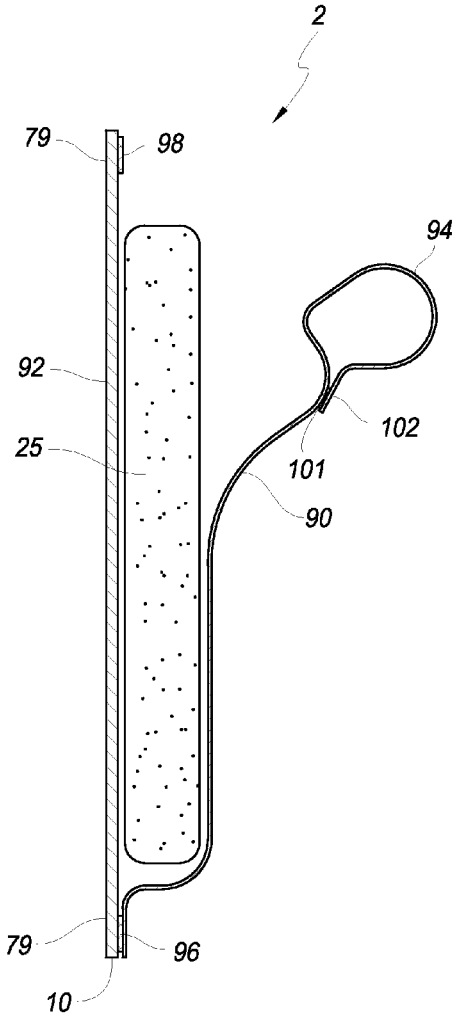

The finger or thumb loop 16 can be made from a same piece of material as the first panel 4 and can be unitary with the first panel 4 as discussed herein, particularly as discussed in reference to FIGS. 11A-B. The finger or thumb loop 16 can be attached to the first panel 4 in any suitable method capable of withstanding the forces required to open the package 2 as discussed herein. In some embodiments, the finger or thumb loop 16 can be attached to the to the first panel 4 using permanent adhesive, reusable adhesive, or a combination of permanent and reusable adhesive, thermal bonds, ultrasonic bonds, spot welds, i.e., thermal weld points, a stitch or stitches, strip welds, tacks formed by crimping, and so forth, including any combination thereof. In other embodiments, the finger or thumb loop 16 can be attached using hooks, fibers, wires and/or other structural reinforcements as discussed herein.

In some embodiments, the package 2 and/or thumb or finger loop 16 can be fabricated with any suitable material to hold an energy bar, energy blocks, energy waffles, energy gels, candy, and/or other similar food or non-food contents. Suitable materials can include polymers (e.g., thermoplastic or thermoset materials). For example, integrally thermoformed plastic, low-density polyethylene (LDPE), medium-density polyethylene (HDPE), high-density polyethylene (HDPE), ultra-high-molecular-weight polyethylene (UHMW), nylon, polyolefin, blends of polyolefin, polystyrene, blends of polyolefin and polystyrene, polyester, and blends of polyester. Other materials can include any type of flexible film, foil, paper, paper composites, and paper laminations with polypropylene, polyester, polyethylene terephthalate (PET), metalized PET, PET film, PE (e.g., LDPE, HDPE, HDPE) film, polyester film, bi-axially oriented polypropylene (BOPP), polyvinyl chloride (PVC), oriented polypropylene (OPP), etc. In some embodiments, the package 2 and/or thumb or finger loop 16 can be fabricated using any suitable or known process or processes, including injection molding, compression molding, and/or thermoforming techniques. The finger or thumb loop 16 can be fabricated from any one or a combination of the aforementioned materials that has sufficient strength to withstand the pulling forces when opening the package 2 as discussed herein. The aforementioned materials can also be used to hold other items such as medical supplies, batteries, and/or tools.

Figure 2A:
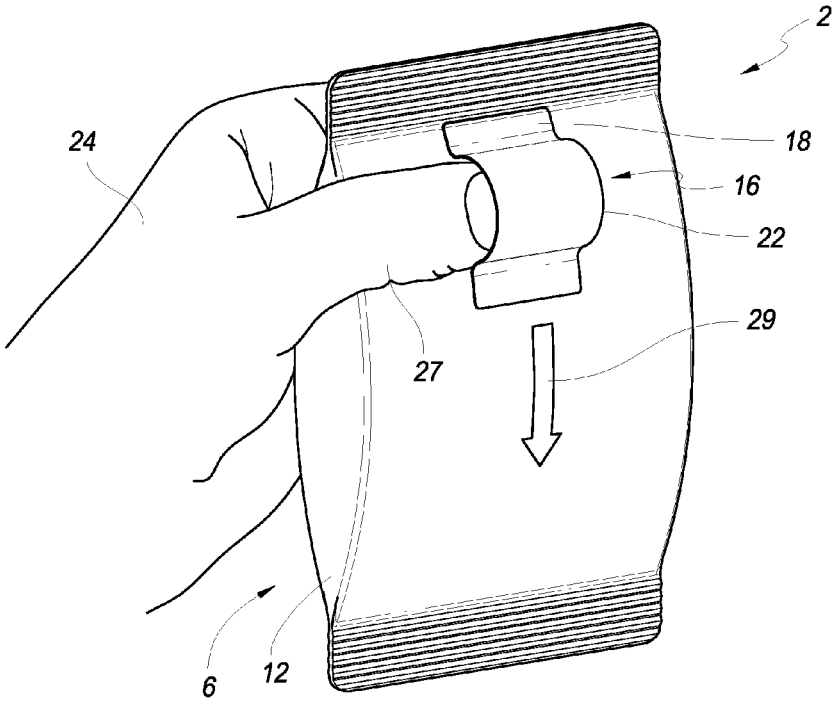
FIGS. 2A-B show a perspective view of the embodiment of an easy-open package of FIG. 1 being opened.
Figure 2B:
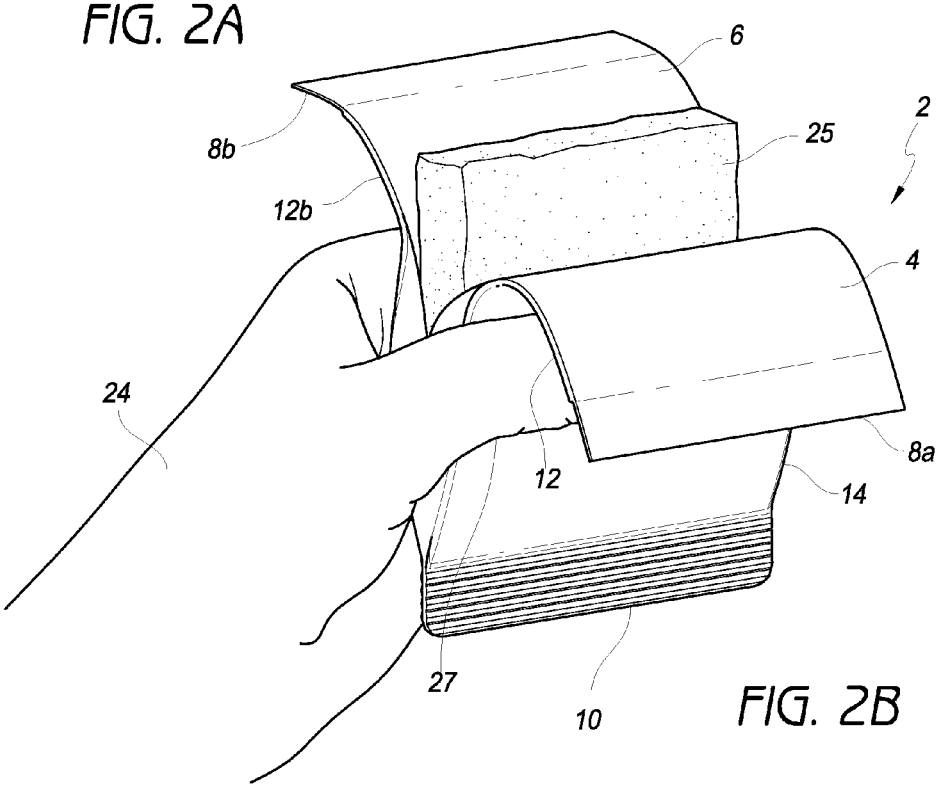

FIGS. 2A-B show a perspective view of the embodiment of an easy-open package 2 of FIG. 1 being opened. As illustrated in FIG. 2A, a user preferably can hold the package with one hand 24 and insert a thumb 27 through the finger or thumb loop 16. The user brings the thumb 16 down in the direction of the arrow 29 depicted on the first panel 4.

The upper end 8 can be sealed using any suitable sealing mechanisms as discussed herein such that when the user applies a downward force with the thumb 27, the package peels open to reveal food (or other) contents 25 as illustrated in FIG. 2B. The opening force required is small enough such that the user can maintain a hold or grip on the package 2 without the package 2 sliding down with the thumb 27. However, the sealing mechanism of the upper end 6 should not be so weak such that the package opens or tears during normal use of the package 2 such as while transporting the package 2. In some embodiments, the opening force can be between 0.5 to 3 lbs., including 1 to 2 lbs., including ranges bordering and including the foregoing values.

In addition to the upper end 8 sealing mechanisms discussed above, the upper end 8 can have perforations, scoring, or weakened, lines, or a combination thereof, that can be formed by, for example, mechanical scoring, thermal scoring, or laser scoring. Similarly, the first side 12 and the second side 14 can have perforations, scoring, or weakened lines, or a combination thereof, such that the user can peel open the package 2 as illustrated in FIG. 2B. Thus, such embodiments do not require the use of a tear away portion or tear strip to open the package 2.

As the user opens the package 2, the seams at the upper end 8 split apart into an upper end 8*a* of the first panel 4 and another upper end 8*b* of the second panel 6. As the user continues opening the package 2, the seams at the first side 12 and the second side 14 split apart into, for example, a first side 12*a* of the first panel 4 and another first side 12*b* of the second panel 6. The user continues bringing down the thumb 27 until satisfactory access to the food contents 25 is attained.

In some embodiments, the package 2 can include a second finger or thumb loops on the second panel 6 such that one or more of the user's fingers can be utilized to assist in opening the package 2. In some embodiments, more than one finger or thumb loop can be placed on the second panel 6. In some embodiments, the second finger or thumb loop on the second panel 6 can mirror the position of the finger or thumb loop 16 on the first panel 4. In some embodiments, the second finger or thumb loop on the second panel 6 can be located anywhere on the second panel 6, conveniently positioned for the user to insert any finger. A second finger or thumb loop can assist the user in performing the action discussed herein of moving the thumb 27 down to open the package 2 with the aid of opposing fingers. In some embodiments, with a second finger or thumb loop, the user can open the package 2 by moving any one or all pointing fingers away (opposite) from the thumb 27 inserted into the finger or thumb loop 16; or vice versa, moving the thumb 27 away (opposite) from any or all pointing fingers. The finger or thumb loops can be securely attached to the first panel 4 and the second panel 6 as discussed herein such that they do not tear away when the user opens the package 2.

Figure 3:
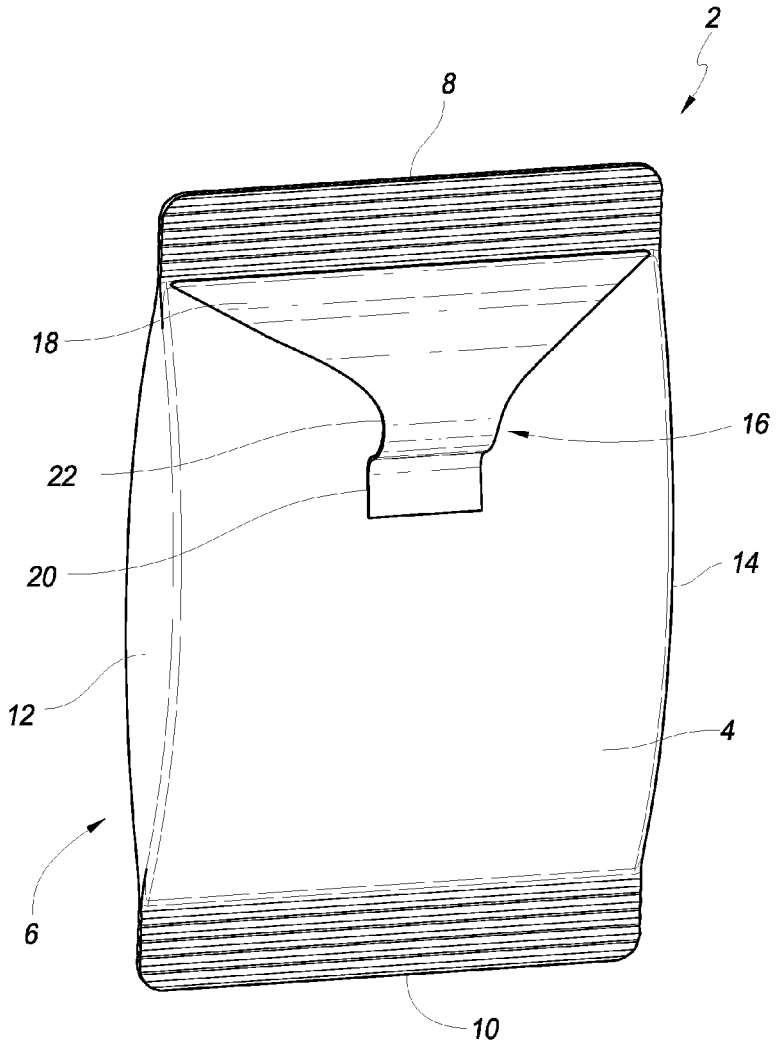
FIG. 3 shows a perspective view of an embodiment of an easy-open package having a finger or thumb loop with an end that is substantially the width of the easy-open package.

FIG. 3 shows a perspective view of an embodiment of an easy-open package 2 having a finger or thumb loop 16 with a first end 18 that is substantially the width of the easy-open package 2. In some embodiments, the first end 18 can be less than the width of the package 2. The first end 18 extending substantially the width of the easy-open package 2 can aid in opening the package 2 as discussed herein. In some embodiments, the finger or thumb loop 16 has a first end 18, a second end 20, and an intermediate portion 22. The first end 18 can be attached at a first region and the second end 20 can be attached at a second region. The intermediate portion 22 can have a length that is greater than the distance between the first region and the second region of attachment of the first end 18 and the second end 20, respectively. With a greater length than the distance between the two regions, the intermediate portion 22 can protrude from the first panel 4 to form a loop of the finger or thumb loop 16. The finger or thumb loop 16 can be located anywhere on the first panel 4. In some embodiments, the first end 18 is integrated with a seam of the upper end 8. In some embodiments, the finger or thumb loop 16 is formed from a same piece of material as the first panel 4 to be integral with the first panel 4 and extend from the first panel 4. In some embodiments, the finger or thumb loop 16 is separate from the seam of the upper end 8. In some embodiments, more than one finger or thumb loop 16 is attached to one or more of the first panel 4 and/or the second panel 6.

Figure 4:
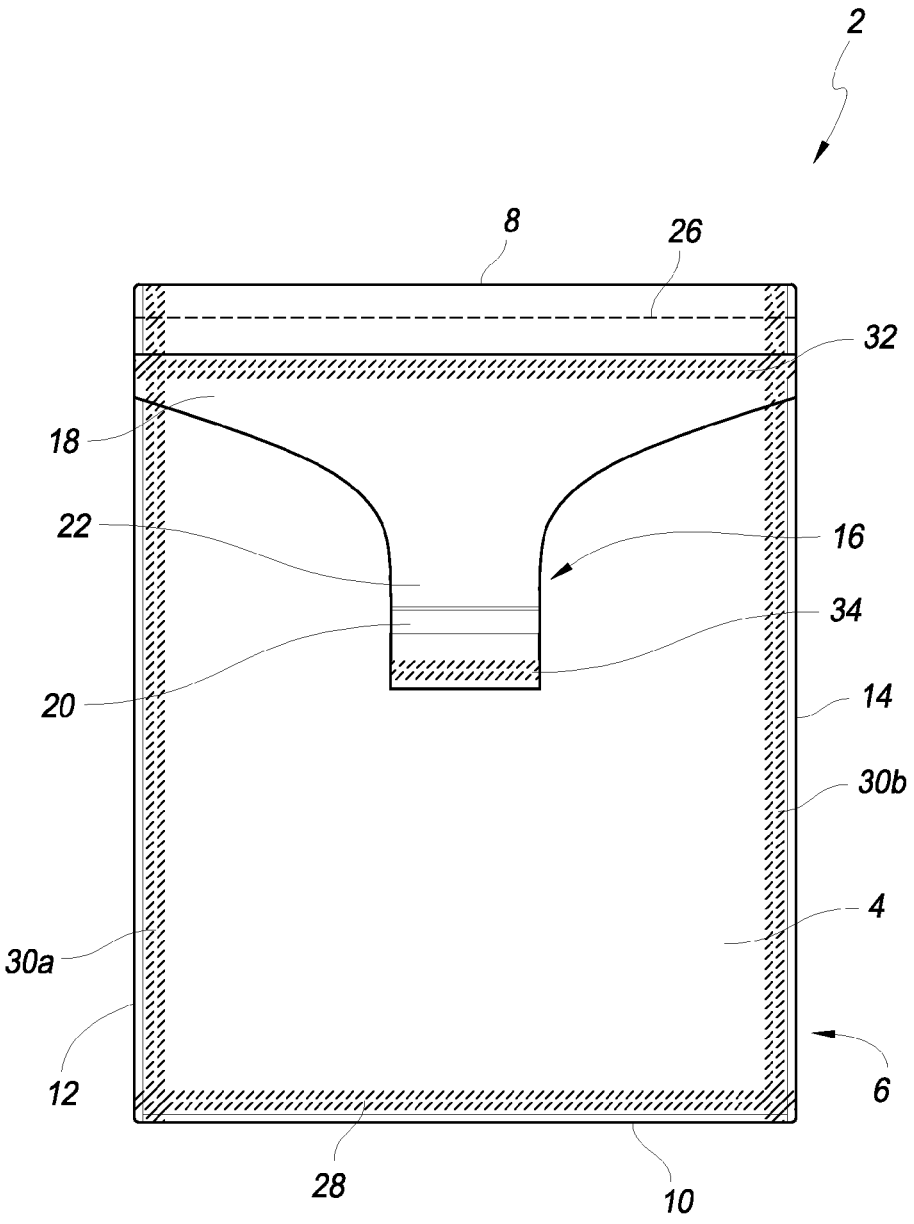
FIG. 4 shows a front view of another embodiment of an easy-open package having a finger or thumb loop with an end that is substantially the width of the easy-open package.

FIG. 4 shows a front view of another embodiment of an easy-open package having a finger or thumb loop 16 with a first end 18 that is substantially the width of an easy-open package 2. The package 2 can have a first seam 26 extending along an upper end 8. The package 2 can have a second seam 28 along extending a lower end 10. The package 2 can have a third seam 30*a* extending along a first side 12. The package can have a fourth seam 30*b* extending along a second side 14. The first seam 26, the second seam 28, the third seam 30*a*, and/or the fourth seam 30*b* can seal a first panel 4 to a second panel 6 to form the package 2. In some embodiments, the package body 2, or the first panel 4 and the second panel 6, can be made of a same piece of material. Such a package 2 can have a first seal 26, a second seal 28, and a single side seal 30*a*. In some embodiments, the single side seal 30*a* extends along the first side 12. In some embodiments, the single side seal 30*a* can be located anywhere along one of the first panel 4 or the second panel 6.

In some embodiments, at least two of the first end 18 of the finger or thumb loop 16 is positioned to be integral with the upper end 8 and can be attached to the first panel 4 at the upper end 8 with the first seam 26. In some embodiments, the first end 18 of the finger or thumb loop 16 is positioned separately from the upper end 8. The first end 18 can be adjacent the upper end 8 and/or the first seam 26. The first end 18 can be attached to the first panel 4 with a fifth seam 32. A second end 20 of the finger or thumb loop 16 can be attached at another region on the first panel 4, away from the first end 18, so as to form a protruding intermediate portion 22 as discussed herein for insertion of finger(s). The second end 20 can be attached to the first panel with a sixth seam 34.

In some embodiments, the first seam 26, the second seam 28, the third seam 30*a*, the fourth seam 30*b*, the fifth seam 32, and/or the sixth seam 34 are each a different strength. In some embodiments, the strength of first seam 26 is less than the strength of the second seam 28. In some embodiments, the strength of the first seam 26 is less than the strength of the second seam 28, the third seam 30*a*, the fourth seam 30*b*, the fifth seam 32, and/or the sixth seam 34. A first seam 26 strength that is less than the strength of the second seam 28, the third seam 30*a*, the fourth seam 30*b*, the fifth seam 32, and/or the sixth seam 34 can aid in opening the package 2 by providing a preferential opening site at the upper end 8 when a user pulls on the finger or thumb loop 16.

In some embodiments, the strength of the third seam 30*a* and the fourth seam 30*b* is equal. The strength of the third seam 30*a* and the fourth seam 30*b* can be more than the first seam 26 strength and less than the second seam 28 strength. This sealing or seam strength arrangement can aid in opening the package 2 as discussed herein, while helping maintain package integrity until the first seam 26 is opened by a user.

In some embodiments, the strength of the fifth seam 32 is greater than the first seam 26 strength. A greater fifth seam 32 strength than the first seam 26 strength can aid in keeping the first end 18 attached to the first panel 4 as a user pulls on the finger or thumb loop 16 to open the first seam 26 and access the food contents of the package 2. In some embodiments, the fifth seam 32 strength is substantially equal to the second seam 28 strength such that the strength of the fifth seam 32 and the second seam 28 generally prevents the seams from coming apart when the user pulls on the finger or thumb loop 16 to open the package 2.

In some embodiments, the equipment used to make this seems can be any standard food package sealer used in the consumer packaging industry. The equipment can include, for example, an AEI-200 Heat Sealer. The AEI-200 Heat Sealer can have 8 heat sealing settings. The higher the setting of the heat sealer, the stronger the seam is when joining two panels. The AEI-200 Heat Sealer can also make a preferential tear line when the heat sealer is used on a single piece of panel material rather than joining two panels. The higher the setting of the heat sealer, the lower the strength of the preferential tear line that is created in the single panel.

In some embodiments, using a setting number 1, 1.5, 2, 2.5, 3, 3.5, 4, 4.5, 5, 5.5, 6, 7, or 8 with an AEI-200 Heat Sealer when sealing two panels together requires a force ranging approximately from 0.5-3 lbs. to separate the seam between the two panels. For example, the separation force can be about 0.5, 0.65, 0.8, 0.95, 1.1, 1.25, 1.4, 1.55, 1.85, 2, 2.3, 2.6, or 3 lbs., including ranges bordering and including the foregoing values.

In some embodiments, the first seam 26 between the first panel 4 and the second panel 6 can be setting number 1 on the AEI-200 Heat Sealer. In some embodiments, the second seam 28 between the first panel 4 and the second panel 6 can be setting number 3 on the AEI-200 Heat Sealer. The third seam 30*a* and the fourth seam 30*b* between the first panel 4 and the second panel 6 can be setting number 1.5 on the AEI-200 Heat Sealer. The fifth seam 32 and the sixth seam 34 attaching the finger or thumb loop 16 to the first plane 4 can be setting number 3 on the AEI-200 Heat Sealer. Thus, with the first seam 26, the second seam 28, the third seam 30*a*, the fourth seam 30*b*, the fifth seam 32, and the sixth seam 34 having the AEI-200 Heat Sealer setting of 1, 3, 1.5, 1.5, 3, 3, respectively, a user is able to separate the first seam 26 at the upper end 8 when pulling on the finger or thumb loop 16, followed by a separation of the third seam 30*a* and the fourth seam 30*b*, while the second seam 28, the fifth seam 32, and the sixth seam 34 remain intact. Other seal strengths can be used with the seal strength of each respective seam preferentially decreasing in the order as discussed herein to aid the user in opening the package 2 with the finger or thumb loop 16. In some embodiments, the first seam 26, the second seam 28, the third seam 30*a*, the fourth seam 30*b*, the fifth seam 32, and/or the sixth seam 34 can be setting number 1, 1.5, 2, 2.5, 3, 3.5, 4, 4.5, 5, 6, 7, and/or 8 on the AEI-200 Heat Sealer.

Figure 5:
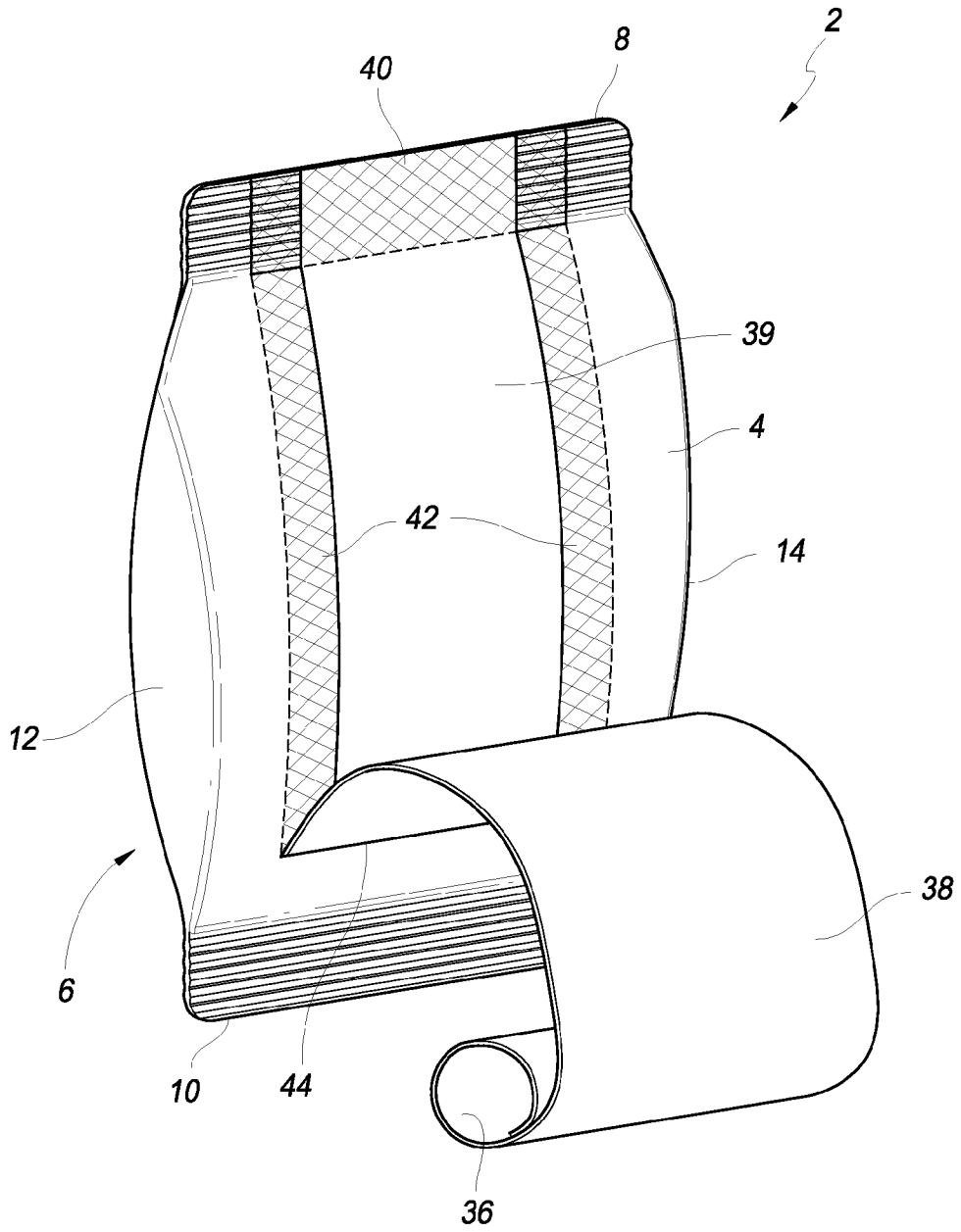
FIG. 5 shows a perspective view of an embodiment of an easy-open package pouch with a flap.

FIG. 5 shows a perspective view of an embodiment of an easy-open package 2 with a flap 38. In some embodiments, the flap 38 covers a package opening 39. In some embodiments, the flap 38 (and opening 39) covers a substantial portion or substantial entirety of the package 2 length and/or width (area), such as at least about 70-80% of the total area of the first panel 4. A large flap 38 (and opening 39) can be useful where the food contents are nearly the size of the package 2, such as one solid energy bar. In some embodiments, the flap 38 may be a smaller portion of the package 2 length. A smaller flap 38 can be useful where the food contents are broken up into blocks, chunks, and/or granules. In some embodiments, the flap 28 opens over only the first panel 4. In other embodiments, the flap 38 opens over the first panel 4 and the second panel 6.

In some embodiments, a finger or thumb loop 36 can be formed as a continuation of the flap 38 that curls on its end and is secured using any suitable sealing mechanisms as discussed herein. In some embodiments, the finger or thumb loop 36 is of a separate piece of material and is attached using any of suitable sealing mechanisms as discussed herein. The opening procedure can be the same as described for FIGS. 2A-B with either one or a combination of two or more finger loops. In some embodiments, the flap 38 can open from the upper end 8 to the lower end 10. In some embodiments, the flap 38 can open from the lower end 10 to the upper end 8.

A top seam 40, side seams 42, and a bottom seam 44 of the flap 38 can utilize any suitable sealing mechanism as discussed herein. In some embodiments, the flap 38 can overlap with the first panel 4 at the top seam 40, side seams 42, and/or bottom seam 44. In some embodiments, the top seam 40, side seams 42, and/or bottom seam 44 can use a reusable adhesive to hold the flap 38 in place. Thus, the flap 38 can be resealed at the top seam 40, side seams 42, and/or bottom seam 44 if the user does not consume the food contents in a single session. In some embodiments, the bottom seam 44 can have a higher strength seal such that the flap 38 does not tear away at the bottom seam 44 upon opening of the package 2. In some embodiments, the bottom seam 44 can be designed to tear away once the package 2 is opened, such as when resealing is not desired. In some embodiments, the flap 38 can be unitary and extend from the first panel 4.

In some embodiments, the top seam 40 can be setting number 1 on an AEI-200 Heat Sealer. In some embodiments, the side seams 42 can be setting number 1.5 on the AEI-200 Heat Sealer. The bottom seam 44 can be setting number 3 on the AEI-200 Heat Sealer. Thus, with the top seam 40, the side seams 42, and the bottom seam 44 having an AEI-200 Heat Sealer setting of 1, 1.5, 3, respectively, a user is able to separate the top seam 40 at the upper end 8 when pulling on the finger or thumb loop 36, followed by a separation of the side seams 42, while the bottom seam 44 remains intact without separation. In some embodiments, the bottom seam 44 can be a setting on an AEI-200 Heat Sealer that is similar to the setting for the top seam 40 and/or the side seams 42 such as, for example, 1 or 1.5 so that the bottom seam 44 can be separated (and the flap 38 accordingly from the package 2) by the user upon pulling on the finger or thumb loop 36. Other seal strengths can be used with the seal strength of each respective seam preferentially decreasing in the order discussed herein to aid the user in opening the package 2 with the finger or thumb loop 16. In some embodiments, the top seam 40, the side seams 42, and/or bottom seam 44 can be setting number 1, 1.5, 2, 2.5, 3, 3.5, 4, 4.5, 5, 6, 7, and/or 8, on an AEI-200 Heat Sealer.

Figure 6A:
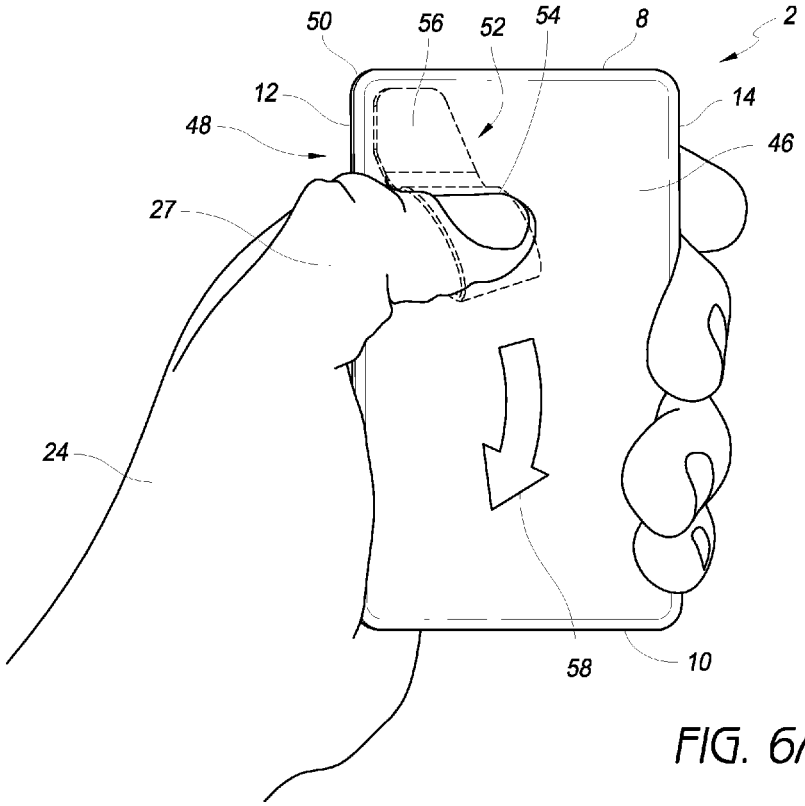
FIGS. 6A-B show a front view of an embodiment of an easy-open package having a finger or thumb loop in a corner of the package used to open the easy-open package.
Figure 6B:
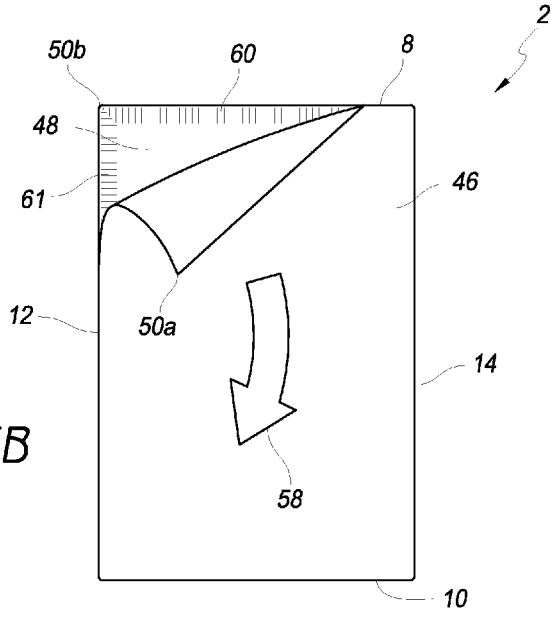

FIGS. 6A-B show a front view of an embodiment of an easy-open package 2 having a finger or thumb loop 52 in a corner 50 of the package used to open the easy-open package 2. In FIG. 6A, the finger or thumb loop 52 can be located at any of the corners of the package 2. Locating the finger or thumb loop 52 at a corner of the package 2 can take advantage of the natural arc motion of a thumb 27. The natural arc motion of the thumb 27 is represented by arrow 58. The finger or thumb loop 52 can have a portion 56 that spaces a loop 54 from the corner 50. The portion 56 can promote the natural motion of the thumb 27 by providing variance in the angle at which the user pulls down the thumb 27 in the direction of arrow 58. A length of the portion 56 can be between about 0.25 and about 1 inch, which can help promote the natural motion of the thumb 27. In some embodiments, the length of the portion 56 can be about 0.125, 0.5, 0.75, 1.25, and 1.5 inches, including ranges bordering and including the foregoing values. The portion 56 can be attached a periphery or peripheral edge as discussed herein, particularly as discussed in reference to FIGS. 9-14.

The finger or thumb loop 52 can be attached to the first panel 46 in any suitable method as discussed herein. The loop 54 of the finger or thumb loop 52 can have a central axis which defines the angle of attachment of the finger or thumb loop 52. The finger or thumb loop 52 can be attached to the corner 50 at any suitable angle such as, for example, the central axis of the loop 54 being parallel relative to one of the upper (first) end 8 or the first side 12. In some embodiments, the finger or thumb loop 52 can be attached to the corner 50 at an angle such as, for example, the central axis of the loop 54 being at any angle or nonparallel relative to the upper (first) end 8 and the first side 12.

In FIG. 6B, opening action of the package 2 using the finger or thumb loop 52 at the corner 50 (corners 50*a* and 50*b*) is illustrated. A corner 50*a* of the first panel 46 is peeled away at a top seam 60 and a side seam 61 starting at a corner 50*b* of a second panel 48 to reveal the second panel 48. The first panel 46 can be a cover layer that is flexible, and the second panel 48 can be a tray that is semi-rigid or less flexible relative to the first panel 46 as discussed herein. The second panel 48 being semi-rigid can assist in removing the first panel 46 from the corner 50. While the top seam 60 and the side seam 61 are illustrated by short parallel lines in FIG. 6B, this is not a necessary physical feature of the second panel 48.

Figure 7:
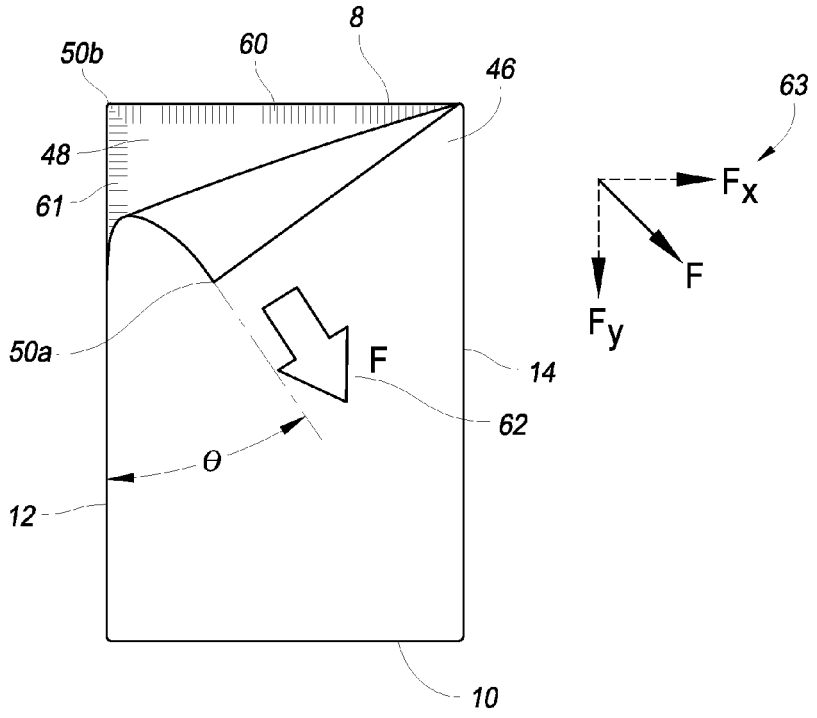
FIG. 7 illustrates a tear force for opening an embodiment of an easy-open package.

FIG. 7 illustrates a tear force F for opening an embodiment of an easy-open package 2. FIG. 7 can relate to the opening action of the package 2 described in FIG. 6B. The package 2 may be easier to open when the pulling force F is applied at an angle θ relative to the first side 12. As the force F is applied at the corner 50, a corner 50*a* of the first panel 46 begins to separate from a corner 50*b* of the second panel 48. A force breakdown 63 shows the component forces of force $F_x$ and force $F_y$ at the corner 50*a*, 50*b* add to result in the opening force F, concentrated at the corner 50*a*, 50*b*. With the concentration of the opening force F at the corner 50*a*, 50*b*, the package 2 can be easier to open relative to attempting to open the package 2 at just the top seam 60. For example, when attempting to open the package 2 over the length of the top seam 60, the user's opening force is substantially spread over the length of the top seam 60. Thus, with the opening force spread over the top seam 60, more opening force may be necessary to open the package 2 than when applying the concentrated opening force F at the corner 50*a*, 50*b*. In some embodiments, the upper end 8 and the first side 12 are perpendicular such that the corner 50*a*, 50*b* is formed by the perpendicular intersection of the upper end 8 and the first side 12. Opening a package 2 at a corner formed by two perpendicular sides, such as the corner 50*a*, 50*b*, can further aid in concentrating the opening force F as discussed herein.

Figure 8A:
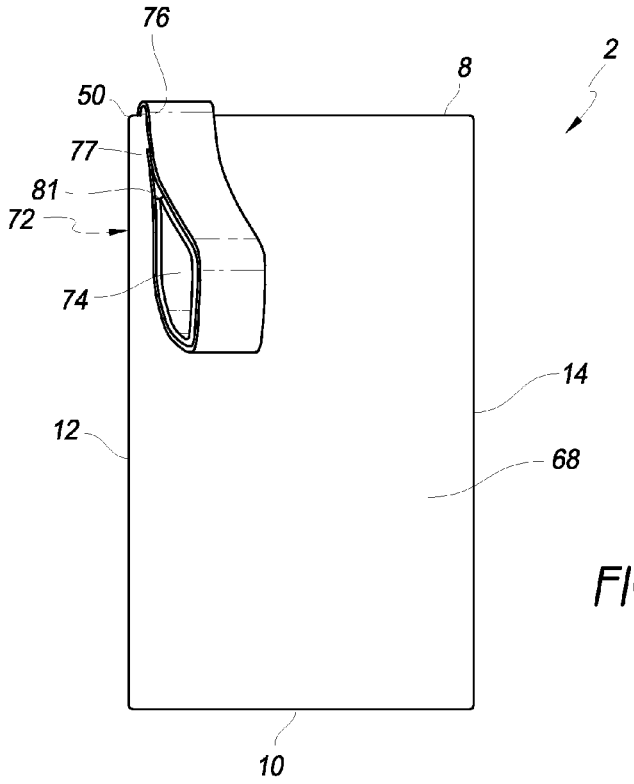
FIGS. 8A-B show a front view and a side view of an embodiment of an easy-open package having a finger or thumb loop in a corner and having a tray.
Figure 8B:
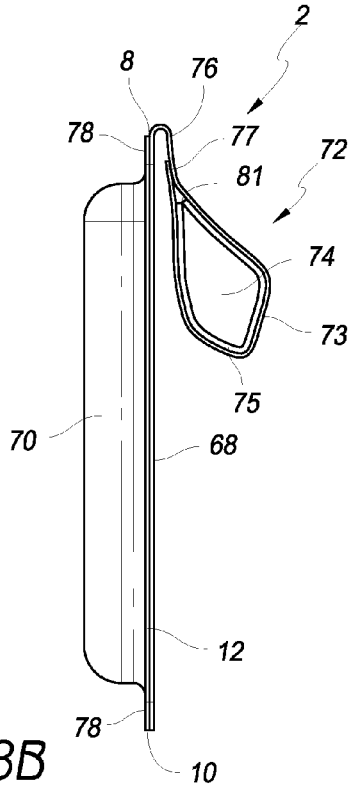

FIG. 8A shows a front view and FIG. 8B shows a side view of an embodiment of an easy-open package 2 having a finger or thumb loop 72 in the corner 50 and having a tray 70. A cover layer 68 is attached at a periphery or peripheral edge 78 of the tray 70 at or near the upper end 8, lower end 10, first side 12, and second side 14 using any suitable method as discussed herein. The cover layer 68 can be the first (front) panel of the package 2 as discussed herein. The tray 70 can be the second (rear) panel of the package 2 as discussed herein. The finger or thumb loop 72 can be attached anywhere on the cover layer 68 using any suitable method as discussed herein. The finger or thumb loop 72 can be attached anywhere on the peripheral edge 78 using any suitable method as discussed herein. The finger or thumb loop 72 can be at any corner, including the corner 50 as discussed herein, using any suitable method as discussed herein. The finger or thumb loop 72 can be parallel or angled relative to one of the upper end 8 and/or first side 12 as discussed herein. The finger or thumb loop 72 can have a portion 76 spacing a loop opening 74 of the finger or thumb loop 72 from the corner 50 as discussed herein. The finger or thumb loop 72 can be attached using any suitable method as discussed herein such that the finger or thumb loop 72 has a stronger seam strength with the cover layer 68 than the seam strength between the cover layer 68 and, for example, the upper end 8, first side 12, and/or second side 14. The cover layer 68 can be attached to the tray 70 using any suitable method as discussed herein, such as, for example, heat sealing the cover layer 68 to the tray at the upper end 8, lower end 10, first side 12, and/or second side 14.

In some embodiments, the cover layer 68 and the finger or thumb loop 72 are formed from a same piece of material. Using the same piece of material, the finger or thumb loop 72 is unitary with the cover layer 68 such that the finger or thumb loop 72 continuously extends from the cover layer 68 at the corner 50. The finger or thumb loop 72 formed from the same piece of material can include the portion 76 spacing the loop opening 74 from the corner 50 as discussed herein. In some embodiments, the finger or thumb loop portion 72 will not have the portion 76, and the loop opening 74 will be formed immediately at the extension of the finger or thumb loop 72 from the cover layer 68 at the corner 50.

The cover layer 68 can be made from metallized polyethylene terephthalate (PET) material. The finger or thumb loop 72 can be made from metallized PET material. In some embodiments, the finger or thumb loop 72 can be made from a substantially similar material that is used to make the cover layer 68. The metallized PET, or substantially similar material of the cover layer 68, of the finger or thumb loop 72 can form a first (outer) layer 73 of the finger or thumb loop 72. As illustrated in FIG. 8B, the finger or thumb loop 72 can include a second (interior) layer 75 preferably that has a greater resiliency than the first layer 73 to assist in urging or biasing the loop 72 into an open orientation (defining an opening or open space 74) in the absence of significant external forces. For example, the loop 72 may be constrained into a closed position while stored (e.g., in a pocket) and will then open once removed from the stored location so that the opening 74 permits finger or thumb access. The second layer 75 can be made from low-density polyethylene (LDPE) material. In some embodiments, the finger or thumb loop 72 can have just a first layer 73 (without a second layer 75) made from LDPE. The finger or thumb loop 72 having a layer made from, for example, LDPE can keep the loop opening 74 open or substantially a circle, oval, or polygon in a side view of the loop opening 74. In some embodiments, the finger or thumb loop 72 can have any single or suitable combination of material and/or material layers that aid in the retention of a desired shape or keep the finger or thumb loop 72 from collapsing while retaining integrity to open the package 2 as discussed herein. The cover layer 68 also can be made from any suitable material, including PET film, PE film, polyolefin, PVC, OPP, LDPE film, HDPE film, polyester film, BOPP, among others disclosed herein or otherwise suitable, for example and without limitation. The loop 72 also can be made from any suitable thermoplastic material, such as HDPE, MDPE, UHMW, among other disclosed herein or otherwise suitable, for example and without limitation.

In some embodiments, the finger or thumb loop 72 can be formed by looping a strip of material onto itself and securing it to itself with a seam 77. The seam 77 can be spaced from the peripheral edge 78 such that the portion 76 is formed. In some embodiments, the portion 76 is unitary with and extends from the cover layer 68. The looped strip of material can form a first layer 73 of the finger or thumb loop 72. A second piece of material can be inserted inside the first layer 73 to form a second layer 75 of the finger or thumb loop 72. The second strip of material that helps retain structural integrity as discussed herein can be a flat piece of material that is formed into a loop such that the ends of the piece of material come together at a junction 81. The forming of the loop of a normally flat piece of sufficiently resilient material can assist in creating the biased-open loop 72, as discussed herein. The junction 81 can be simply a meeting (or adjacency) of the ends of the piece of material or can be a connection formed by sealing two ends of the second strip of material or can be formed using any other suitable sealing mechanism as discussed herein. In some embodiments, the second material can be a continuous second piece of material without the junction 81. The second layer 75 can be sealed, adhered, and/or attached using any other suitable mechanism discussed herein to the first layer 73. In some embodiments, the seam 77 and the junction 81 are the same seam or same connection. In such embodiments, the first layer 73 and the second layer 75 are both sealed at the location of seam 77 to form a single, four-layer seam.

The finger or thumb loop 16 can have other structural reinforcements to help retain its shape. The structural reinforcement can, for example, be a semi-rigid wire or fiber of any suitable material embedded into the finger or thumb loop 72 in a vertical, horizontal, or diagonal axis, or any combination thereof, of the finger or thumb loop 72, such that the finger or thumb loop 72 retains its shape for easy finger or thumb insertion. Other forms of structural reinforcement can include making the material of the finger or thumb loop 72 thicker in comparison to the material thickness of the cover layer 68. Any structure or method discussed herein for a finger or thumb loop or other similar feature to retain a loop-like shape, an open shape, or other desired shapes can be called "loop open technology." In some embodiments, the finger or thumb loop 72 can be made of any suitable material that does not necessarily retain a desired shape.

The tray 70 can be made from high-density polyethylene (HDPE) or any other suitable material such that the tray 70 preferably has a higher rigidity than the cover layer 68. The higher relative rigidity of the tray 70 can aid in opening the package 2 using the finger or thumb loop 72 as discussed herein. For example, when a user pulls on the finger or thumb loop 72 to create an opening force at any one of the seams attaching the cover layer 68 to the tray 70, the tray 70 retains its shape while the cover layer 68 is pulled off from the tray 70 as discussed herein, particularly in reference to FIGS. 6A-B and 7.

Figure 9A:
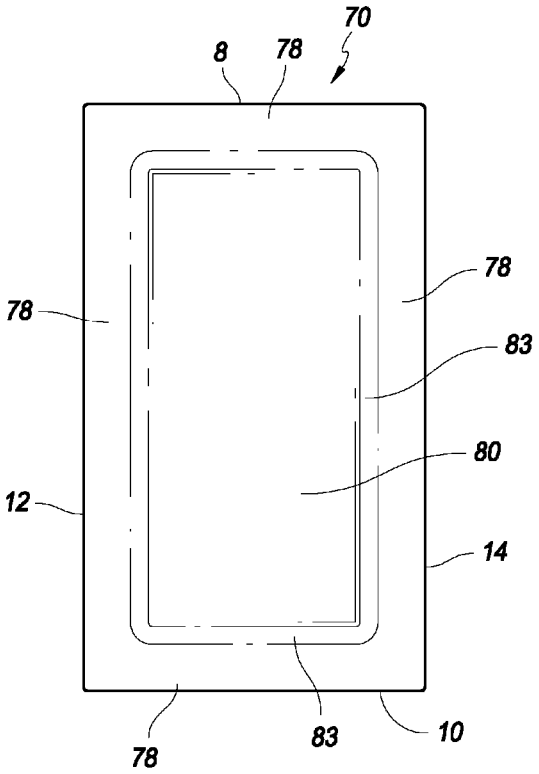
FIGS. 9A-C show a front view and a side view of a tray of an embodiment of an easy-open package.
Figure 9B:
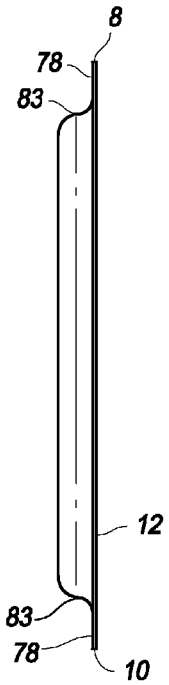
Figure 9C:
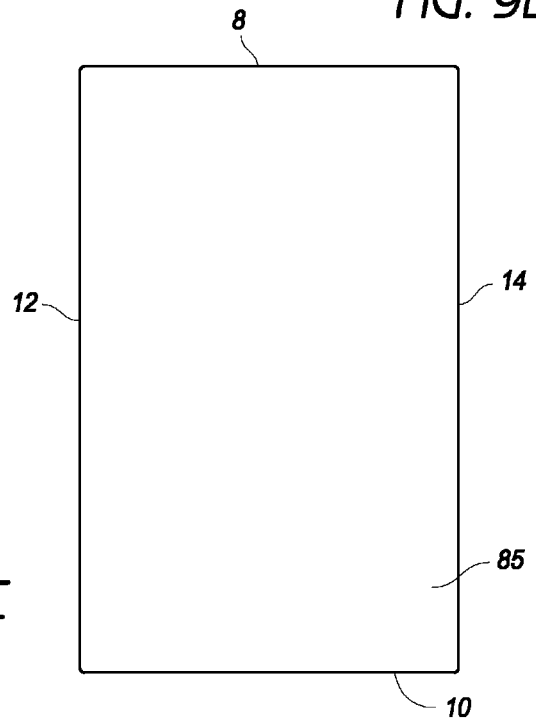

FIG. 9A shows a front view of a tray 70 of an embodiment of an easy-open package 2 with a thermoformed (or otherwise formed) interior portion 80. The tray 70 can be the second panel as discussed herein. FIG. 9B shows a side view of the tray 70 with the interior portion 80. FIG. 9C shows a front view of the tray 70 prior to thermoforming. The tray 70 can have a periphery or peripheral edge 78 at or near the upper end 8, lower end 10, first side 12, and second side 14. A cover layer 68 is attached or adhered to the peripheral edge 78 using any suitable method discussed herein. The peripheral edge 78 circumscribes an interior portion 80. The interior portion 80 can be thermoformed along the peripheral edge 78 with a flat piece of material 85 that is shown in FIG. 9C. When the cover layer 68 is attached or adhered to the peripheral edge 78, the energy food is enclosed in or on the interior portion 80 of the tray 70. The interior portion 80 can be an interior space formed from the tray 70 by thermoforming (or otherwise forming) side walls 83 such that the interior space of the interior portion 80 can receive food contents. The side walls 83 can extend fully the depth of the food contents such that the cover layer 68 is flush with the peripheral edge 78 upon enclosing the food contents in the interior portion 80. The side walls 83 can extend substantially fully the depth of the food contents such that the cover layer 68 is generally or nearly flush with the peripheral edge 78 upon enclosing the food contents in the interior portion 80. The side walls 83 can extend less than the depth of the food contents such that the cover layer 68 is not flush with the peripheral edge 78 and the food contents cause the cover layer to bulge or extend out from the peripheral edge 78 upon enclosing the food contents in or on the interior portion 80.

In some embodiments, the tray 70 can have a width of about 2.25 inches, which can aid a user in holding the package with one hand while maintain a size large enough for containing or enclosing the desired contents. In some embodiments, the width of the tray 70 can be about 1.5, 1.75, 2, 2.5, 2.75, 3, 3.25, 3.5, 3.75, and 4 inches, including ranges bordering and including the foregoing values. In some embodiments, the tray 70 can have a length of about 3.875 inches, which can aid a user in holding the package with one hand while maintain a size large enough for containing or enclosing the desired contents. In some embodiments, the length of the tray 70 can be about 2, 2.5, 2.75, 3, 3.25, 3.5, 3.75, 4, 4.25, 4.5, 4.75, 5, 5.25, 5.5, 5.75, and 6 inches, including ranges bordering and including the foregoing values. In some embodiments, the tray 70 and/or flat piece of material 85 can have a thickness of about 0.03 inches, which can aid in containing or enclosing the desired contents while avoiding material waste. In some embodiments, the thickness of the tray 70 and/or flat piece of material 85 can be about 0.005, 0.01, 0.015, 0.02, 0.025, 0.035, 0.04, 0.045, 0.05, 0.055, and 0.06 inches, including ranges bordering and including the foregoing values. In some embodiments, the peripheral edge 78 can have a height of about 0.25 inches, which can aid in containing or enclosing the desired contents while avoiding material waste. In some embodiments, the height of the peripheral edge 78 can be about 0.1, 0.15, 0.2, 0.3, 0.35, and 0.4 inches, including ranges bordering and including the foregoing values. In some embodiments, the interior portion 80 can have a depth (or height of side walls 83) of about 0.25 inches, which can aid in containing or enclosing the desired contents while avoiding material waste. In some embodiments, the depth of the interior portion 80 can be about 0.1, 0.15, 0.2, 0.3, 0.35, and 0.4 inches, including ranges bordering and including the foregoing values. In some embodiments, the flat piece of material 85 can have a width of about 2.5 inches, which can aid a user in holding the package with one hand, once thermoformed as in FIGS. 9A-B, while maintain a size large enough for containing or enclosing the desired contents. In some embodiments, the width of the flat piece of material 85 can be about 1.25, 1.5, 1.75, 2, 2.25, 2.75, 3, 3.25, 3.5, 3.75, 4, and 4.25 inches, including ranges bordering and including the foregoing values. In some embodiments, the flat piece of material 85 can have a length of about 4 inches, which can aid a user in holding the package with one hand once thermoformed while maintain a size large enough for containing or enclosing the desired contents. In some embodiments, the length of the flat piece of material 85 can be including about 1.75, 2, 2.25, 2.5, 2.75, 3, 3.25, 3.5, 3.75, 4.25, 4.5, 4.75, 5, 5.25, 5.5, 5.75, 6, and 6.25 inches, including ranges bordering and including the foregoing values. The relatively larger dimensions of the flat piece of material 85 can be such that the desired dimensions of the tray 70 are attained after thermoforming (or otherwise forming) the interior portion 80 from the flat piece of material 85 to form the tray 70.

Figure 10A:
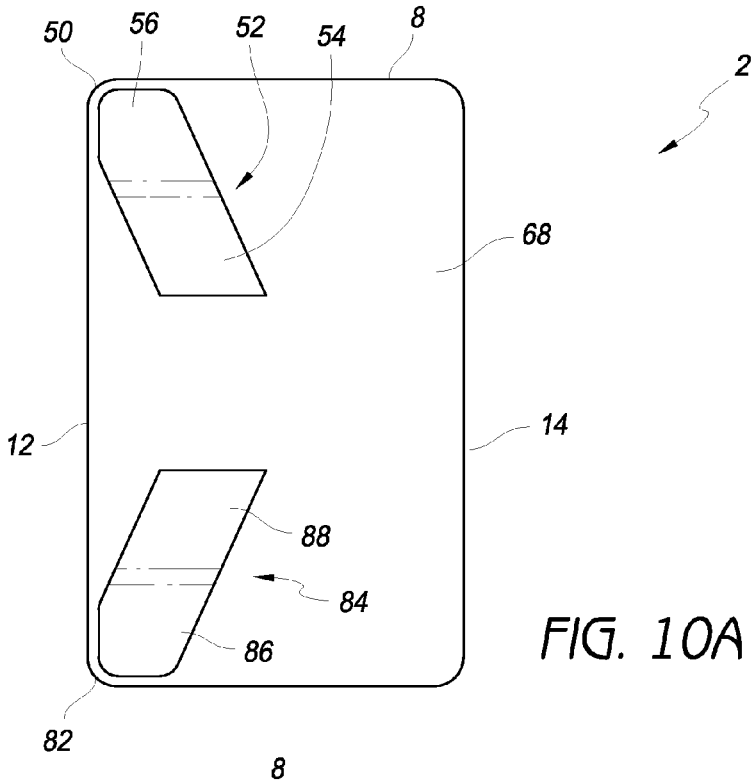
FIGS. 10A-B show a front view and a cross-sectional view of an embodiment of an easy-open package having a tray and two finger or thumb loops.
Figure 10B:
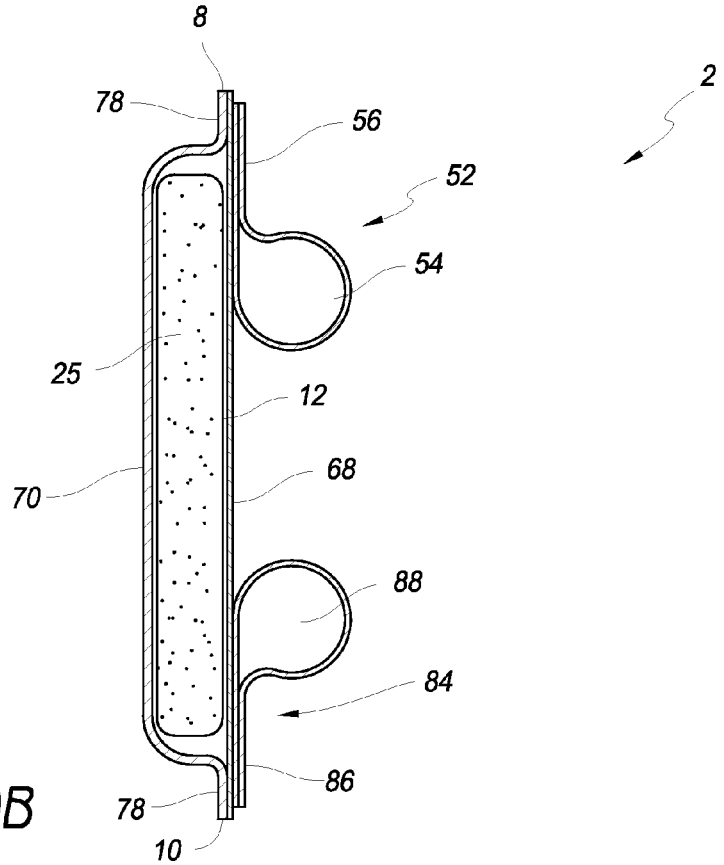

FIGS. 10A-B show a front view and a cross-sectional view of an embodiment of an easy-open package 2 having a tray 70 and two finger or thumb loops 52, 84. A cover layer 68 is attached at a periphery or peripheral edge 78 of the tray 70 at or near the upper end 8, lower end 10, first side 12, and second side 14 using any suitable method as discussed herein. The cover layer 68 can be the first (front) panel of the package 2 as discussed herein. The tray 70 can be the second (rear) panel of the package 2 as discussed herein. In FIG. 10A, the two finger or thumb loops 52, 84 can be located in any one of the corners of the package 2. The first finger or thumb loop 52 can be located at a first corner or first location 50. The second finger or thumb loop 84 can be located at a second corner or second location 82. The first location 50 can be at the upper end 8. The first location 50 can be at the first side 12. The first location 50 can be at the second side 14. The second location 82 can be at the lower end 10. The second location 82 can be at the first side 12. The second location 82 can be at the second side 14. The finger or thumb loops 52, 84 can be located such that a user can use a left or right hand for opening the package 2. The first finger or thumb loop 52 and/or the second finger or thumb loop 84 can have the open loop technology as discussed herein.

Locating the finger or thumb loops 52, 84 at corners of the package 2 can take advantage of the natural arc motion of a thumb as discussed herein. The first finger or thumb loop 52 can have a first portion 56 that spaces a first loop 54 from the first corner 50. The second finger or thumb loop 84 can have a second portion 86 that spaces a second loop 88 from the second corner 82. The first and second portion 56, 86 can promote the natural motion of a thumb by providing variance in the angle at which the user pulls on the first finger or thumb loop 52 and/or second finger or thumb loop 84.

The finger or thumb loops 52, 84 can be attached to the cover layer 68 in any suitable method as discussed herein. The loops 54, 88 can have a central axis which defines the angle of attachment of the finger or thumb loops 52, 84. The first finger or thumb loop 52 and/or second finger or thumb loop 84 can be attached to the corners 50, 82 at any suitable angle such as, for example, the central axis (axes) of the first loop 54 and/or the second loop 88 being parallel relative to the upper (first) end 8 and/or the first side 12. In some embodiments, the first finger or thumb loop 52 and/or second finger or thumb loop 84 can be attached to the corners 50, 82 at an angle such as, for example, the central axis (axes) of the first loops 54 and/or the second loops 88 being at any angle or nonparallel relative to the upper (first) end 8 and/or the first side 12.

In some embodiments, the cover layer 68 and the first finger or thumb loop 52 and/or the second finger or thumb loop 84 are formed from a same piece of material. Using the same piece of material, the first finger or thumb loop 52 and/or the second finger or thumb loop 84 is (are) unitary with the cover layer 68 such that the first finger or thumb loop 52 and/or the second finger or thumb loop 84 continuously extend(s) from the cover layer 68 at the first corner 50 and/or the second corner 82. The first finger or thumb loop 52 and/or the second finger or thumb loop 84 formed from the same piece of material can include a first portion 56 and/or a second portion 86 spacing the first loop 54 and/or the second loop 88 from the first corner 50 and/or the second corner 82. In some embodiments, the first finger or thumb loop 52 and/or the second finger or thumb loop 84 will not have the first portion 56 and/or the second portion 86, and the first loop 54 and/or the second loop 88 will be formed immediately at the extension of the finger or thumb loops 52, 84 from the cover layer 68 at the first corner 50 and/or the second corner 82.

FIGS. 11A-B show a cross-sectional view of another embodiment of an easy-open package 2 having a tray 92. In FIG. 11A, an illustrated embodiment includes a tray 92 that is substantially flat. The flat tray 92 can be a flat piece of material as discussed in reference to FIG. 9C. The tray 92 can have a periphery or peripheral edge 79 defining an interior portion where the food contents 25 can be located. The cover layer 90 can attach at the peripheral edge 79 with a first seam 96 at a lower end 10 and a second seam 98 at an upper end 8. The tray 92 can be the first (front) panel of the package 2 as discussed herein. The cover layer 90 can be the second (rear) panel of the package 2 as discussed herein. With a flat tray 92, upon insertion of the food contents and attachment of the cover layer 90 as discussed herein, the cover layer 90 protrudes from the tray 92, wrapping the food contents 25 as illustrated in FIG. 11A. The cover layer 90 can be attached to the tray 92 using any suitable method as discussed herein. The package 2 can include a finger or thumb loop 94 that is formed from a same piece of material as the cover layer 90 such that finger or thumb loop 94 extends from and is unitary with the cover layer 90. The finger or thumb loop 94 can have a first end 101 that is attached to the cover layer using a third seam 102 to form the finger or thumb loop 94. The finger or thumb loop 94 can have the open loop technology as discussed herein.

The tray 92 can be made from high-density polyethylene (HDPE) or any other suitable material such that the tray 92 has a higher rigidity than the cover layer 90. The cover layer 90 can be made from low-density polyethylene (LDPE) material. The tray 92 having a higher rigidity than the cover layer 90 can provide a semi-rigid backing that aids in the finger or thumb loop 94 in pulling apart the second seam 98 to pull the cover layer 90 from the tray 92.

A method of manufacture can include first attaching the cover layer 90 to the tray 92 with the first seam 96. Upon insertion of the food contents 25, the cover layer 90 is attached to the tray 92 using the second seam 98. The first end 101 can be wrapped around and attached to the cover layer 90 with the third seam 102 at a location near the second seam 98, leaving sufficient length of the material extending from the cover layer 90 to form the finger or thumb loop 94. In some embodiments, the strength of the first seam 96, the second seam 98, and the third seam 102 is each different. In some embodiments, the strength of the first seam 96 and the third seam 102 is the same. In some embodiments, the strength of the second seam 98 is less than the strength of the first seam 96 and/or the third seam 102. Having a second seam 98 strength that is less than the strength of the first seam 96 and/or third seam 102 can help provide a preferential opening site to access the food contents 25 when a user pulls on the finger or thumb loop 94 as illustrated in FIG. 11B. Thus, with such an arrangement of seam strength, the first seam 96 and the third seam 102 can remain intact while the second seam 98 parts when the user pulls on the finger or thumb loop 94.

Figure 12A:
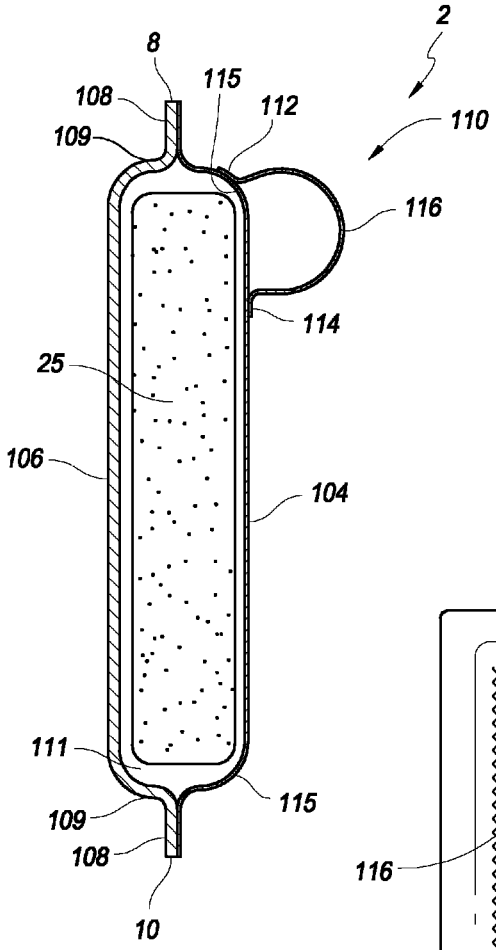
FIGS. 12 A-B show a cross-sectional view and a front view of yet another embodiment of an easy-open package having a tear line.

FIGS. 12 A-B show a cross-sectional view and a front view of an embodiment of an easy-open package 2 having a tear line 118. In FIG. 12A, an illustrated embodiment includes a tray 106 with an interior portion 111. The interior portion 111 can be an interior space formed from a peripheral edge 108 of the tray 106 by extending side walls 109 such that the interior portion 111 can receive food contents 25. The side walls 109 can extend about ¼, ⅓, ½, ¾, or ⅔, including ranges bordering and including the foregoing values, the depth of the food contents 25 such that a cover layer 104 protrudes from the peripheral edge 108 about ¼, ⅓, ½, ¾, or ⅔, including ranges bordering and including the foregoing values, the depth of the food contents 25.

The cover layer 104 can be attached to the tray 106 using any suitable method as discussed herein. The package 2 can include a finger or thumb loop 110. The finger or thumb loop 110 can have a first end 112, a second end 114, and an intermediate portion 116. The first end 112 can be attached anywhere (a first region) on the cover layer 104. The first end 112 can be attached at or near an upper end 8 of the package 2. The first end 112 can be attached at a transition region 115 of the cover layer 104. The transition region 115 can be at a location on the cover layer 104 where the cover layer 104 angles from covering the length of the food contents 25 to covering the depth of the food contents. The second end 114 can be attached at a second region spaced apart the first region such that the distance between the first end 112 and the second end 114 is shorter than the length of the intermediate portion 116. The intermediate portion 116 can protrude from the cover layer 104 to form a loop for the insertion of a finger or thumb. The finger or thumb loop 110 can be attached to the cover layer 104 at the first end 112 and the second end 114 using any suitable method as discussed herein. The finger or thumb loop 110 can have the open loop technology as discussed herein. The seams at the first end 112 and the second end 114 can be of equal or greater strength than the seams at the upper end 8, the lower end 10, the first side 12, and/or the second side 14 such that the finger or thumb loop 110 does not separate from the cover layer 104 before the package 2 is opened as discussed herein.

Figure 12B:
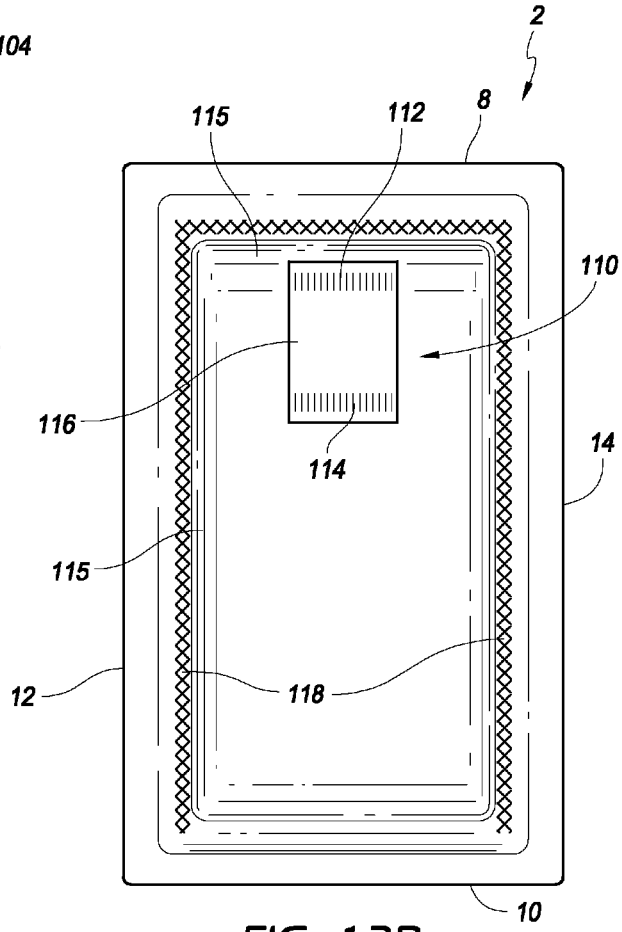

In FIG. 12B, a cover layer 104 with a tear line 118 is illustrated. The tear line 118 can be formed at or near the transition region 115. The tear lines 118 can be between the upper end 8 and the first end 112 of the finger or thumb loop 110 to form a flap as discussed herein in reference to FIG. 5. The tear line 118 can provide a preferential opening path when a user pulls on the finger or thumb loop 110. In some embodiments, the tear line 118 can be formed by using an AEI-200 Heat Sealer on just the cover layer 104 (without sealing the cover layer 104 to another piece of material). The AEI-200 Heat Sealer number setting can be number 7 to form the tear line 118. The AEI-200 Heat Sealer number setting can be number 3 to form seams at the upper end 8, the lower end 10, the first side 12, the second side 14, first end 112, and/or the second end 114. As the user pulls on the finger or thumb loop 110 with a thumb or finger, the cover layer 104 can tear or come part along the tear line 118 while the other seams stay intact. The AEI-200 Heat Sealer number setting can be any suitable number setting to form the tear line 118. The AEI-200 Heat Sealer number setting can be any suitable number setting such that the seams at the upper end 8, the lower end 10, the first side 12, the second side 14, first end 112, and/or the second end 114 the cover layer 104 stay intact when the finger or thumb loop 110 is pulled.

Figure 13A:
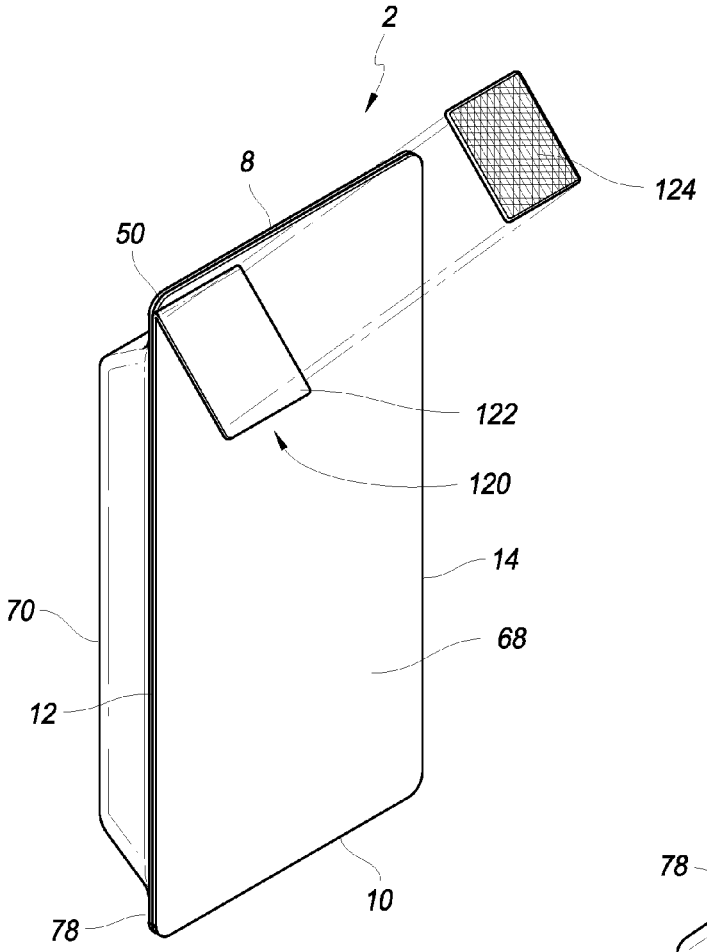
FIGS. 13A-B show a perspective view and a side view of an embodiment of an easy-open package having a tray and a finger or thumb grip portion.
Figure 13B:
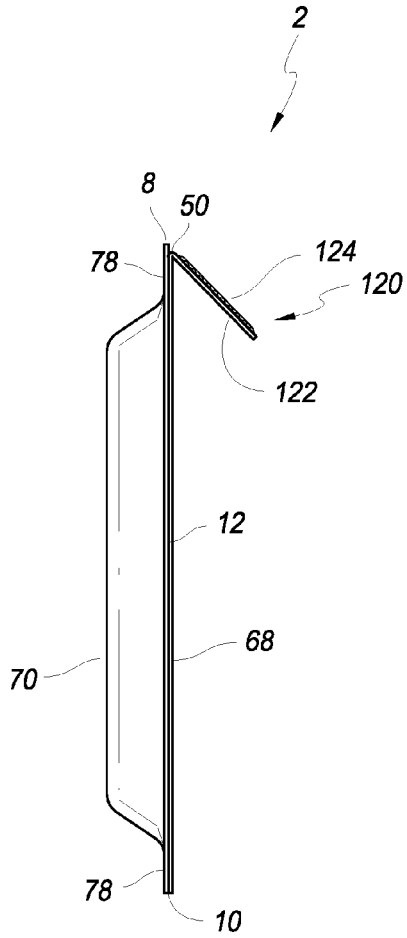

FIGS. 13A-B show a perspective view and a side view of an embodiment of an easy-open package 2 having a tray 70 and a finger or thumb grip portion 120. A cover layer 68 is attached at a periphery or peripheral edge 78 of the tray 70 at or near the upper end 8, lower end 10, first side 12, and second side 14 using any suitable method as discussed herein. The cover layer 68 can be the first (front) panel of the package 2 as discussed herein. The tray 70 can be the second (rear) panel of the package 2 as discussed herein. The tray 70 can be recessed from the peripheral edge 78 to include an interior portion as discussed herein. The cover layer 68 can be attached to the tray 70 using any suitable method as discussed herein, such as, for example, heat sealing the cover layer 68 to the tray at the upper end 8, lower end 10, first side 12, and/or second side 14.

The finger or thumb grip portion 120 can be attached anywhere on or near the peripheral edge 78 of the tray 70 using any suitable method as discussed herein. The finger or thumb grip portion 120 can be located at any of the corners of the package 2. In some embodiments, the finger or thumb grip portion 120 is located at a corner 50 of the package 2. The finger or thumb grip portion 120 can be parallel or angled relative to of the upper end 8 and/or first side 12. The finger or thumb grip portion 120 can have a portion spacing a grip portion 124 from, for example, the corner 50 as discussed herein. In some embodiments, the package 2 can include two or more finger or thumb grip portions 120 as discussed herein for finger or thumb loops, particularly in reference to FIGS. 10A-B. The finger or thumb grip portion 120 can be attached using any suitable method as discussed herein such that the finger or thumb grip portion 120 has a stronger seam strength with the cover layer 68 than the seam strength between the cover layer 68 and, for example, the upper end 8, first side 12, and/or second side 14.

In some embodiments, the cover layer 68 and the finger or thumb grip portion 120 are formed from a same piece of material. Using the same piece of material, the finger or thumb grip portion 120 is unitary with the cover layer 68 such that the finger or thumb grip portion 120 continuously extends and protrudes from the cover layer 68 at, for example, the corner 50. The finger or thumb grip portion 120 can include an enhanced friction surface portion 124. The enhanced friction surface portion 124 can have a coefficient of friction that is greater than a coefficient of friction of the cover layer 68 such that a user can press against and pull down on the enhanced grip portion 124 to remove of the cover layer 68 from the tray 70. The extending portion 122 can have a smooth surface such that the smooth surface slides on the cover layer 68 when pressed against the cover layer 68 by application of force against the enhanced friction surface portion 124. Thus, the sliding surfaces of the extending portion 122 and the cover layer 68 that are in contact can be smooth to aid in the sliding mechanism as discussed herein.

In some embodiments, the enhanced friction surface portion 124 can be grip tape having an enhanced friction surface on one side and an adhesive backing on another side. The grip tape or enhanced friction surface portion 124 can be adhered to the extending portion 122 to form the finger or thumb grip portion 120. In some embodiments, the finger or thumb grip portion 120 can be the extending portion 122 having a smooth surface facing the cover layer 68 and an enhanced friction surface facing away from the cover layer 68. An enhanced friction surface of the extending portion 122 can be formed by ridges or ribs pressed into or formed in the extending portion 122. Other enhanced friction surfaces can be made using any suitable method, including scoring, sanding, and/or adhering friction features.

Figure 14A:
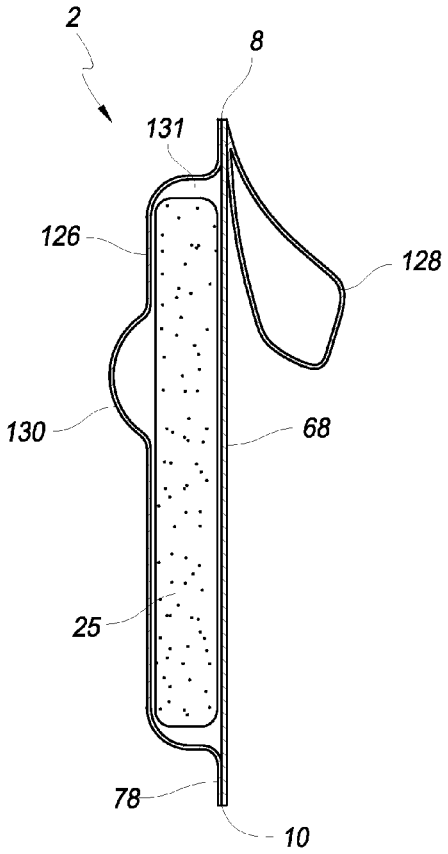
FIGS. 14A-B show a cross-sectional view of an embodiment of an easy-open package having a tray and a protrusion.
Figure 14B:
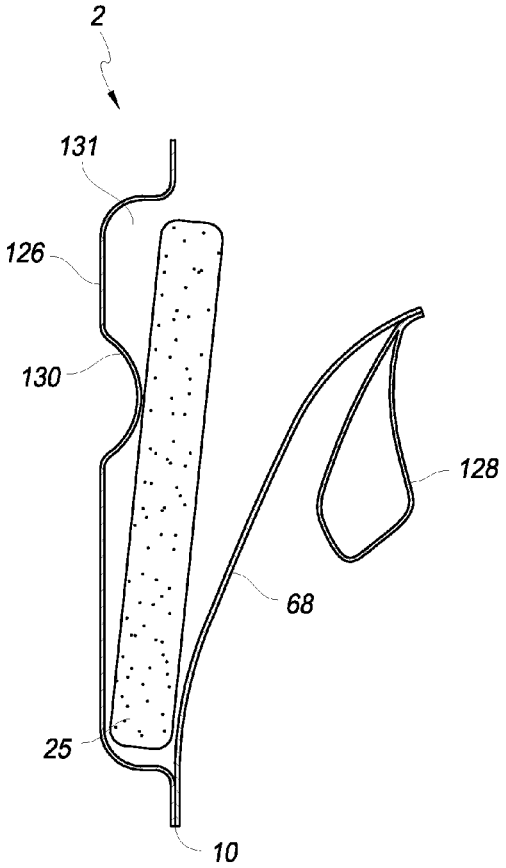

FIGS. 14A-B show a cross-sectional view of an embodiment of an easy-open package 2 having a tray 126 and a protrusion 130. A cover layer 68 is attached at a periphery or peripheral edge 78 of the tray 126 at or near the upper end 8, lower end 10, first side 12, and second side 14 using any suitable method as discussed herein. The cover layer 68 can be the first (front) panel of the package 2 as discussed herein. The tray 70 can be the second (rear) panel of the package 2 as discussed herein. The tray 70 can be recessed at the peripheral edge 78 to include an interior portion or an interior space 131 for food contents 2. The finger or thumb loop 128 can be attached anywhere on or near the peripheral edge 78 of the tray 70 using any suitable method, including extending for a same piece of material as the cover layer 68, as discussed herein. The finger or thumb loop 128 can be attached using any suitable method as discussed herein such that the finger or thumb loop 128 has a stronger seam strength with the cover layer 68 than the seam strength between the cover layer 68 and for example an upper end 8. The finger or thumb loop 128 can have the open loop technology as discussed herein.

In some embodiments, the package 2 can include a feature that helps at least partially eject or separate the bar from the package 2. In some embodiments, the feature is a protrusion 130. The protrusion 130 can have any suitable shape such as, for example and without limitation, hemispherical, cylindrical, fully or partially annular, elliptical, rectangular, and/or oblong. The particular size and/or shape can be selected to provide desired operating attributes, such as ease of deformation or surface area acting on the contents of the package 2, for example and without limitation. For example, an oblong protrusion 130 that extends in a lengthwise direction of the package 2 can contact a greater portion of a length of the package contents (e.g., a food bar) to separate a greater portion of the contents from the tray 70 and/or project the contents a greater distance from the tray 70. The protrusion 130 can initially extend in a first direction away from the interior space 131. Upon opening of the food package 2 to access the food contents 25 within, the protrusion can extend in a second direction into the interior space 131 to separate the food contents 25 from at least a portion of the tray 126 that is adjacent to the protrusion 130 as illustrated in FIG. 14B. In some embodiments, the protrusion 130 can be depressed by a user upon opening the package 2. In some embodiments, the protrusion 130 or other similar feature can be biased to extend in the second direction into the interior space 131. The protrusion 130 or other similar feature can be placed in the first direction (not ejecting the food contents 25) and sealed. The protrusion 130 can be held in the first direction while the package 2 is sealed (while the cover layer is adhered to the tray 126). Upon separating the cover layer 68 from the tray 126, the protrusion 130 can automatically extend in the second direction into the interior space 131 to at least partially eject or separate the food contents 25 from the package 2. In some embodiments, the protrusion can be biased such that the extension in the second direction into the interior space 131 is semi-automatic where the user applies only a relatively slight force for the protrusion 130 to reverse itself in the second direction. In some embodiments, the protrusion 130 does not have to reverse on itself from a first direction into a second direction. The protrusion 130 can be a surface that moves against the food contents 25 upon at least partially removing the cover layer 68 from the tray 126. A protrusion 130 can help in removing the food contents 25 from the package 2 where the food contents 25 stick to the tray 126.

The protrusion 130 can be offset from a center of a length and/or width of the tray 126. In some embodiments, the protrusion is located closer to the upper end 8 as compared to the lower end 10 such that the protrusion 130 is closer to the finger or thumb loop 128. In some embodiments, the protrusion 130 is formed from a same piece of material as the tray 126 and is unitary with the tray 126. In some embodiments, a depth of the protrusion is about ¼, ⅓, ½, ¾, or ⅔, including ranges bordering and including the foregoing values, of a depth of the interior space 131 in the first direction and/or the second direction. In addition to the depth, the surface area of the protrusion 130 can be selected to provide desirable attributes in separating the food contents 25 (or other contents) from the tray 126 and/or projecting the food contents 25 (or other contents) from the interior space 131 of the tray 126. This selection may be based on the likelihood of the food contents 25 (or other contents) sticking to the tray 126 or tenacity with which the contents stick to the tray 126, in addition to a variety of other reasons. In general, it can be desirable for the surface area of the protrusion 130 to be a significant proportion of the total area of the tray 126 such that the protrusion 130 is useful in separating the contents 25 from the tray 126 and/or projecting the contents 25 from the tray. Thus, preferred protrusions 130 in general are more significant in size than surface dimpling or other features provided for ornamentation or strength purposes. In some embodiments, the protrusion(s) 130 is at least about 5%, 10%, 15%, 20% or more of the total surface area of the tray 126, including ranges bordering and including the foregoing values.

Figure 15A:
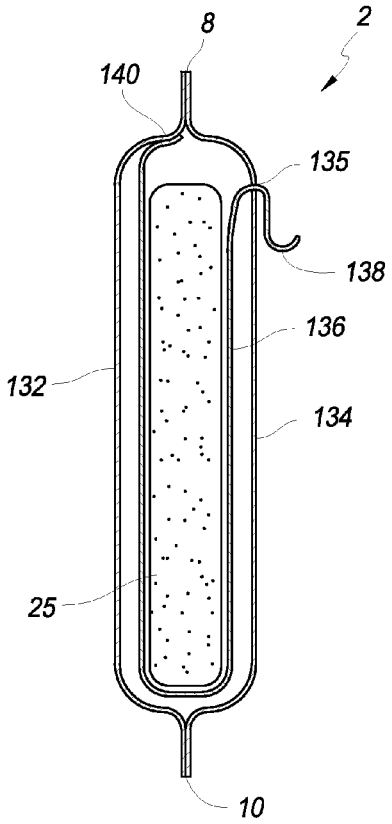
FIGS. 15A-B show a cross-sectional view of an embodiment of an easy open package having a liner.
Figure 15B:
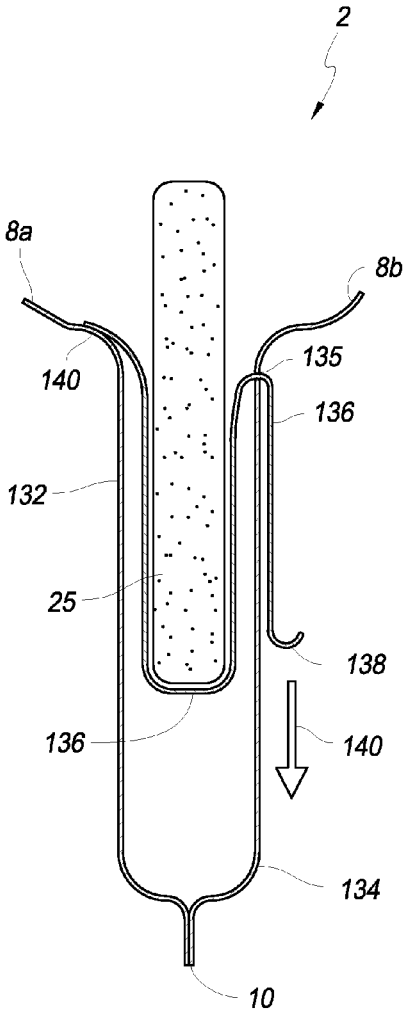

FIGS. 15A-B show a cross-sectional view of an embodiment of an easy open package 2 having a liner 136. In some embodiments, the package 2 can be made with two layers of material. The package 2 can have a first panel 132 and a second panel 134 sealed as discussed herein at an upper end 8 and a lower end 10, forming an outer wrapper or first material layer. The package 2 can have a liner 136, forming an inner wrapper or second material layer. The liner 136 is attached to the first panel 132 at a region 140. The attachment at the region 140 can use any suitable sealing mechanism discussed herein to withstand the tension forces necessary to remove the food contents 25 from the package 2.

The liner 136 wraps around or underneath the food contents 25, such as a solid energy bar, and can protrude through an opening 135 on the second panel 134. The liner 136 can form a finger or thumb gripping portion as discussed herein, finger or thumb loop as discussed herein, or such as a finger or thumb hook 138 as illustrated in FIGS. 15A-B. The finger or thumb hook 138 can be formed using structural reinforcement mechanisms or open loop technology for a finger or thumb loop as discussed herein. In some embodiments, the first panel 132 and/or the second panel 134 can have one or more finger or thumb loops and/or grip portions to aid in opening the package 2. In some embodiments, the finger or thumb hook 138 can be accessible through an opened upper end 8 once the package 2 has been opened using one or more finger or thumb loops and/or grip portions on the first panel 132 and/or the second panel 134.

In some embodiments as illustrated in FIG. 15B, a user pulls downward on the finger or thumb hook 138, indicated by arrow 140. The liner 136 can move relative to the rest of the packaging 2. The pulling action can be performed by either the user's thumb or any of the pointing fingers. As more of the length of the liner 136 is pulled out from the opening 135, the liner 136 contacts the bottom of the food contents 25 near the lower end 10 to lift the food contents 25 past the upper end 8. As the food contents 25 are pushed up by the liner 136, consequently pushing on the upper end 8, the upper end 8 opens into a first upper end 8*a* and a second upper end 8*b* for the food contents 25 to emerge from the package 2. Thus, the liner 136 pushing on the food contents 25 can assist in opening the package 2.

Figure 16A:
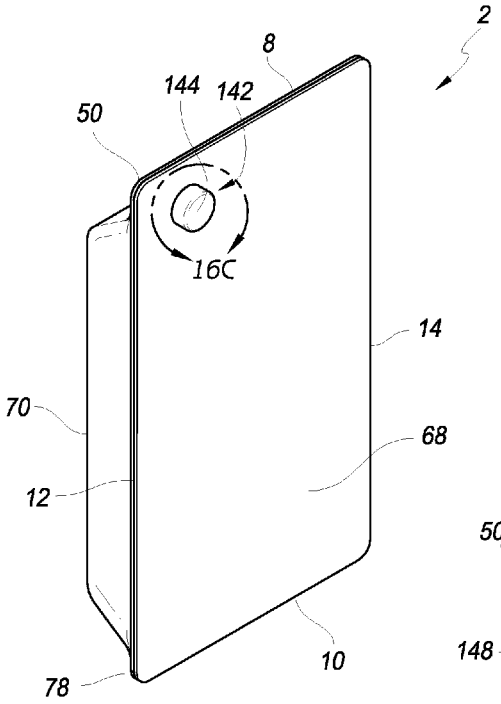
FIGS. 16A-C show a perspective view and a front view of an embodiment of an easy-open package having a tray and finger or thumb holds, and a perspective view of the finger or thumb holds.
Figure 16B:
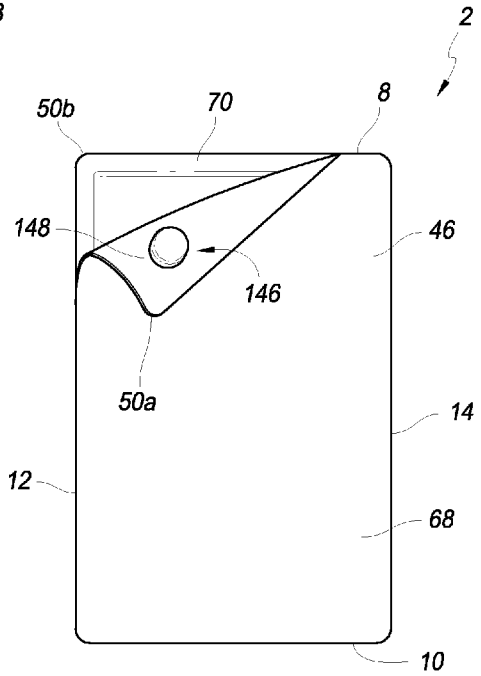

FIGS. 16A-B show a perspective view and a front view of an embodiment of an easy-open package 2 having a tray 70 and one or more finger or thumb grips, knobs or holds 142, 146. A cover layer 68 is attached at a periphery or peripheral edge 78 of the tray 70 at or near the upper end 8, lower end 10, first side 12, and second side 14 using any suitable method as discussed herein. The cover layer 68 can be the first (front) panel of the package 2 as discussed herein. The tray 70 can be the second (rear) panel of the package 2 as discussed herein. The tray 70 can be recessed from the peripheral edge 78 to include an interior portion as discussed herein. The cover layer 68 can be attached to the tray 70 using any suitable method as discussed herein, such as, for example, heat sealing the cover layer 68 to the tray at the upper end 8, lower end 10, first side 12, and/or second side 14.

The finger or thumb grip, knob or hold 142 (hereinafter "hold") can be anywhere on or near the peripheral edge 78 of the tray 70 using any suitable method as discussed herein. The finger or thumb hold 142 can be located at any of the corners of the package 2. In some embodiments, the finger or thumb hold 142 is located at or near a corner 50 of the package 2. In some embodiments, the package 2 can include two or more finger or thumb holds 142 in any suitable locations, such as those discussed herein for finger or thumb loops, particularly in reference to FIGS. 10A-B. The finger or thumb hold 142 can be an integrated feature of the cover layer 68 as discussed herein and/or can be attached using any suitable method as discussed herein such that the finger or thumb hold 142 has a stronger attachment strength with the cover layer 68 than the seam strength between the cover layer 68 and, for example, the upper end 8, first side 12, and/or second side 14.

Figure 16C:
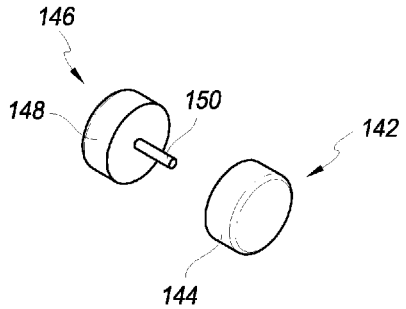

In some embodiments, the finger or thumb hold 142 is a protruding structure (e.g., a button, knob, grip or hold) that has a finger or thumb grip surface, which preferably extends outwardly from an adjacent surface of the cover layer 68 such that a user's finger or thumb can get sufficient grip or leverage on the hold 142 to assist with the opening and/or partial or complete removal of the cover layer 68. The hold 142 can be any size sufficient to provide the desired utility in a given application. In some arrangements, the hold 142 can extend at least about ⅛ inch, at least about 3/16 inch, at least about ¼ inch or at least about 5/16 inch from the adjacent surface of the cover layer 68, including ranges bordering and including the foregoing values. The hold 142 can work with any size finger and/or with a user wearing gloves. The hold 142 can have an enhanced friction surface portion. The enhanced friction surface portion can have a coefficient of friction that is greater than a coefficient of friction of the cover layer 68 such that a user can press against and pull down on the enhanced grip portion of the finger or thumb hold 142 to remove a portion or an entirety of the cover layer 68 from the tray 70. In some embodiments, the finger or thumb hold 142 can have similar features and function similarly as the finger or thumb grip portion discussed herein, particularly in reference to FIGS. 13A-B. In some embodiments, the finger or thumb hold 142 can be a knob 144 as illustrated in FIGS. 16A-C. The knob 144 can be attached to the cover layer 68 with adhesives or any other suitable method as discussed herein. The knob 144 can provide a gripping or holding surface such that a user can pull down on the knob 144 to remove the cover layer 68 from the tray 70. In some embodiments, the embodiments discussed herein in reference to FIGS. 1-15 can include one or more finger or thumb holds 146 to further assist the user in opening the package 2 as discussed herein.

The package can have an internal finger or thumb hold 146. The internal finger or thumb hold 146 can be any feature as discussed herein for the finger or thumb hold 142, including an enhanced friction surface and/or a knob 148. The internal finger or thumb hold 146 can have substantially the same dimensions and characteristics as the finger or thumb hold 142, including an inwardly projecting knob 148. The internal finger or thumb hold 146 can be a feature or can be attached on an inside face of the cover layer 68 such that the internal finger or thumb hold 146 can assist the user in removing the cover layer 68 from the tray 70 once the corner 50*a* of the cover layer 68 has been pulled apart from the a corner 50*b* of the tray 70 (by, for example, using the finger or thumb hold 142). For example, a method of opening the package 2 can include the user pulling on the finger or thumb hold 142 until the corner 50*a* of the cover layer 68 separates from the corner 50*b* of the tray 70 and the internal finger or thumb hold 146 is accessible on the inside face of the cover layer 68. Then the user pulls on the internal finger or thumb hold 146 to continue the opening process of the package 2, further separating the cover layer 68 from the tray 70. The internal finger or thumb hold 146 can work with any size finger and/or with a user wearing gloves.

In some embodiments, the package 2 can include two or more internal finger or thumb holds 146 as discussed herein for finger or thumb loops, particularly in reference to FIGS.

10A-B, and being located on the inside face of the cover layer 68. In some embodiments, the embodiments discussed herein in reference to FIGS. 1-15 can include one or more internal finger or thumb holds 146. In some embodiments, the embodiments discussed herein in reference to FIGS. 1-15 can include a finger or thumb loop and/or a finger or thumb grip portion on the inside layer of the cover layer 68 (or the first panel and/or the second panel). In some embodiments, the combination of one or more finger or thumb loops, finger or thumb grip portions, and/or finger or thumb holds can be included in the package 2 on an outside face and/or an inside face of the first panel and/or the second panel.

FIG. 16C shows a perspective view of the finger or thumb holds 142, 146. FIG. 16C illustrates how the finger or thumb hold 142 can be attached to the associated internal finger or thumb hold 146. In some embodiments, the finger or thumb hold 142 and/or the internal finger or thumb hold 146 includes a pin(s) 150. The finger or thumb hold 142 can be positioned at a location on the cover layer 68 or attached at the location on the cover layer 68 using an adhesive or any other suitable method as discussed herein. The internal finger or thumb loop 146 can be positioned at a location on the cover layer 68 or attached at the location on the cover layer 68 using an adhesive or any other suitable method as discussed herein. The pin 150 enters the finger or thumb hold 142 and/or the internal finger or thumb hold 146 to secure the two finger or thumb holds 142, 146 to each other. The pin 150 can be secured with friction fit, crimping, and/or adhesive. Alternatively, any other suitable structure or method for coupling the finger or thumb holds 142, 146 can be used. In some embodiments, the finger or thumb holds 142, 146 are a continuous piece and can be secured to the cover layer 68 through an opening in the cover layer 68. The continuous piece finger or thumb hold 142, 146 can be secured with friction fit, slot/notch fit, and/or adhesive.

The foregoing detailed description has set forth various embodiments of the systems and/or methods via the use of figures and/or examples. Insofar as such figures and/or examples contain one or more functions and/or operations, it will be understood by those within the art that each function and/or operation within figures or examples can be implemented individually and/or collectively. The herein-described subject matter sometimes illustrates different components contained within, or connected with, different other components. It is to be understood that such depicted architectures are merely examples, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced embodiment recitation is intended, such an intent will be explicitly recited in the embodiment, and in the absence of such recitation no such intent is present. For example, as an aid to understanding, the following disclosure may contain usage of the introductory phrases "at least one" and "one or more" to introduce embodiment recitations. However, the use of such phrases should not be construed to imply that the introduction of an embodiment recitation by the indefinite articles "a" or "an" limits any particular embodiment containing such introduced embodiment recitation to embodiments containing only one such recitation, even when the same embodiment includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce embodiment recitations. In addition, even if a specific number of an introduced embodiment recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C" or "one of the A, B, or C," etc. is used, in general such a construction is intended in the sense one having skill in the art would understand the convention (e.g., "a system having at least one of A, B, and C (or one of the A, B, or C)" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, embodiments, or drawings, should be understood to contemplate the possibilities of including one of the terms, either of the terms, or both terms. For example, the phrase "A or B" will be understood to include the possibilities of "A" or "B" or "A and B."

While various aspects and embodiments have been disclosed herein, other aspects and embodiments will be apparent to those skilled in the art. The various aspects and embodiments disclosed herein are for purposes of illustration and are not intended to be limiting.

What is claimed is:

1. An easy-open energy food package, comprising:

a package body sized and shaped to be held in a single hand of a user, the package body comprising a front panel and a rear panel defining a space therebetween to receive an energy food, the package body having a first end, a second end opposite the first end, a first side extending between the upper end and the lower end and a second side opposite the first side extending between the first end and the second end;

at least one finger or thumb loop secured to the front panel or the rear panel, wherein the at least one finger or thumb loop is constructed from a first material and wherein the package body is constructed from a second material that is different than the first material, wherein the first material has resilient properties sufficient to create a force tending to open the at least one finger or thumb loop;

wherein the at least one finger or thumb loop is further constructed from a second material such that the first material forms a first layer of the at least one finger or thumb loop and the second material forms a second layer of the at least one finger or thumb loop, wherein the second material of the at least one finger or thumb loop is substantially non-resilient.

2. The food package of claim 1, wherein the at least one finger or thumb loop comprises a portion and a loop, and wherein the portion is secured at a region of one of the front panel and the rear panel, the portion spacing the loop from the region.

3. The food package of claim 2, wherein the region is a peripheral edge of the front panel, and wherein the portion spaces the loop from the peripheral edge.

4. The food package of claim 1, wherein the first layer and the second layer circumscribe entirely the at least one finger or thumb loop.

5. The food package of claim 1, wherein the first layer forms an inside layer of the at least one finger or thumb loop and the second layer forms an outside layer of the at least one finger or thumb loop.

6. The food package of claim 1, wherein the first material comprises a thermoplastic material.

7. The food package of claim 6, wherein the second material comprises a flexible film material.

8. The easy-open energy food package of claim 2, wherein the portion extends outwardly from the region of the one of the front panel and the rear panel and is flexible such that the portion can assume a curved shape to allow the at least one finger or thumb loop to overlap the one of the front panel and the rear panel.

* * * * *